US010352162B2

(12) United States Patent
Kristensen et al.

(10) Patent No.: US 10,352,162 B2
(45) Date of Patent: Jul. 16, 2019

(54) CLEANUP MODEL PARAMETERIZATION, APPROXIMATION, AND SENSITIVITY

(71) Applicant: Schlumberger Technology Corporation, Sugar Land, TX (US)

(72) Inventors: Morten Kristensen, Auning (DK); Cosan Ayan, Istanbul (TR); Ryan Sangjun Lee, Sugar Land, TX (US); Nikita Chugunov, Arlington, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 601 days.

(21) Appl. No.: 15/005,531

(22) Filed: Jan. 25, 2016

(65) Prior Publication Data

US 2016/0216404 A1 Jul. 28, 2016

Related U.S. Application Data

(60) Provisional application No. 62/106,978, filed on Jan. 23, 2015.

(51) Int. Cl.
*E21B 49/10* (2006.01)

(52) U.S. Cl.
CPC ..... *E21B 49/10* (2013.01)

(58) Field of Classification Search
CPC ..... E21B 49/10
See application file for complete search history.

(56) References Cited

U.S. PATENT DOCUMENTS 8,548,785 B2 10/2013 Chugunov et al.
8,744,774 B2 * 6/2014 Zazovsky ..... E21B 49/087 166/264
9,121,263 B2 9/2015 Zazovsky et al.
(Continued)

FOREIGN PATENT DOCUMENTS

WO WO2014116896 A1 7/2014

OTHER PUBLICATIONS

Akram A.H., Halford F.R. and Fitzpatrick A.J. 1999. A Model to Predict Wireline Formation Tester Sample Contamination. SPE Reservoir Eval. & Eng. 2(6). Dec. 1999, pp. 499-505.
(Continued)

*Primary Examiner* — S. Sough
*Assistant Examiner* — Kimberly L Jordan
(74) *Attorney, Agent, or Firm* — Michael Dae

(57) ABSTRACT

Methods and systems for generating and utilizing a proxy model that generates a pumping parameter as a function of contamination. The pumping parameter is descriptive of a pumpout time or volume of fluid to be obtained from a formation by a downhole sampling tool positioned in a wellbore extending into the formation. The contamination is a percentage of the fluid obtained by the downhole sampling tool that is not native to the formation. The proxy model is based on a true model that utilizes true model input parameters that include the pumping parameter, formation parameters descriptive of the formation, and a filtrate parameter descriptive of a drilling fluid utilized to form the wellbore. The output of the true model is the contamination as a function of the pumping parameter. The proxy model utilizes proxy model input parameters each related to one or more of the true model input parameters.

20 Claims, 15 Drawing Sheets

(56) References Cited

U.S. PATENT DOCUMENTS

| | | | | |
|---|---|---|---|---|
| 2010/0294491 | A1* | 11/2010 | Zazovsky | E21B 49/08 166/250.01 |
| 2011/0087459 | A1 | 4/2011 | Zazovsky et al. | |
| 2013/0110483 | A1 | 5/2013 | Chugunov et al. | |
| 2014/0278110 | A1 | 9/2014 | Chugunov et al. | |
| 2015/0060053 | A1 | 3/2015 | Chugunov et al. | |
| 2015/0211361 | A1* | 7/2015 | Gisolf | E21B 49/08 702/12 |
| 2015/0355374 | A1 | 12/2015 | Morton et al. | |
| 2016/0090836 | A1* | 3/2016 | Wang | E21B 49/08 702/12 |
| 2016/0145977 | A1 | 5/2016 | Chugunov et al. | |
| 2016/0186559 | A1* | 6/2016 | Wang | E21B 49/10 702/6 |
| 2016/0186562 | A1* | 6/2016 | Lee | E21B 49/081 702/6 |

OTHER PUBLICATIONS

Alpak F.O., Elshahawi H., Hashem M., and Mullins 0 .2006. Compositional Modeling of Oil-Based Mud-Filtrate Clean-up During Wireline Formation Tester Sampling. SPE paper 100393 presented at the SPE Annual Technical Conference and Exhibition, San Antonio, Texas, USA, Sep. 24-27, 2006 (17 pages).

Archer, G.E.B., Saltelli A., and Sobol' I.M. 1997. Sensitivity Measures, ANOVA-like Techniques and the Use of Bootstrap. Journal of Statistical Computation and Simulation. 58. 99-120.

Augustin, F., Gilg, A., Paffrath, M., Rentrop, P. and Wever, U. 2008. Polynomial Chaos for the Approximation of Uncertainties: Chances and Limits, Euro. J. of Applied Mathematics. vol. 19, Issue 2, Apr. 2008, pp. 149-190.

Chin W.C. and Proett M. 2005. Formation Tester Immiscible and Miscible Flow Modeling for Job Planning Applications. Presented at the SPWLA 46th Annual Logging Symposium, New Orleans, Louisiana, USA, Jun. 26-29, 2005 (16 pages).

Homma, T. and A. Saltelli. 1996. Importance Measures in Global Sensitivity Analysis of Nonlinear Models. Reliability Engineering and System Safety. 52( I). 1-17.

Kucherenko S., Feil B., Shah N., and Mauntz W. 2011. The Identification of Model Effective Dimensions Using Global Sensitivity Analysis. Reliability Engineering and System Safety. 96 (4). 440-449.

Lophaven S.N., Nielsen H.B., and Soendergaard J. 2002. DACE: A Matlab Kriging Toolbox v. 2.0. Technical Report IMM-TR-2002-12. Informatics and Mathematical Modeling. Technical University of Denmark. (28 pages).

McCalmost S., Onu C., Wu J., Kiome P. , Sheng J.J., Adegbola F., Rajasingham R., and Lee J. 2005. Predicting Pumpout Volume and Time Based on Sensitivity Analysis for an Efficient Sampling Operation: Pre-job Modeling Through a Near-Well bore Simulator. SPE paper 95885 presented at the SPE Annual Technical Conference and Exhibition, Dallas, Texas, USA, Oct. 9-12, 2005 (11 pages).

McKay M.D., Beckman R.J., and Conover W.J. 1979. A Comparison of Three Methods for Selecting Values of Input Variables in the Analysis of Output from a Computer Code. Technometrics. 21(2), May 1979, pp. 239-245.

Sacks J., Welch W.J., Mitchell T.J., and Wynn H.P. 1989. Design and Analysis of Computer Experiments. Statistical Science. 4(4), Nov. 1989, pp. 409-435.

Saltelli, A., 2002. Making the Best Use of Model Evaluations to Compute Sensitivity Indices. Computer Physics Communications. 145. 280-297.

Saltelli, A., Ratto M., Andres T., Campolongo F., Cariboni J., Gatelli D., Saisana M., and Tarantola S. 2008. Global Sensitivity Analysis. The Primer. Wiley-Interscience (305 pages).

Sobol', I.M., 1990, Quasi Monte-Carlo methods. Progress in Nuclear Energy. vol. 24, pp. 55-61.

Sobol', I.M., 1993, Sensitivity Estimates for Nonlinear Mathematical Models. Mathematical Modeling and computational Experiment. vol. 1, No. 4, pp. 407-414.

Storlie, C.B., Swiler L.P., Helton J.C., and Sallaberry C.J. 2009. Implementation and Evaluation of Nonparametric Regression Procedures for Sensitivity Analysis of Computationally Demanding Models. Reliability Engineering and System Safety. 94 (11). 1735-1763.

Tarantola, S., Becker W., and Zeitz D. 2012. A Comparison of Two Sampling Methods for Global Sensitivity Analysis. Computer Physics Communications. 183. 1061-1072.

Weiner, N. 1938. The Homogeneous Chaos. Amer. J. Math. 60. 897-936.

* cited by examiner

CLEANUP MODEL PARAMETERIZATION, APPROXIMATION, AND SENSITIVITY

CROSS-REFERENCE TO RELATED APPLICATIONS

This application claims priority to and the benefit of U.S. Provisional Patent Application No. 62/106,978, titled "Cleanup Model Parameterization, Approximation, and Sensitivity," filed Jan. 23, 2015, the entire disclosure of which is hereby incorporated herein by reference.

This application is also related to the following references, the entire disclosures of which are hereby incorporated herein by reference:

U.S. Pat. No. 9,121,263 to Zazovsky, et al.;
U.S. Publication No. 2013-0110483 of Chugunov, et al.;
U.S. Publication No. 2014-0278110 of Chugunov, et al.;
U.S. Pat. No. 8,548,785 to Chugunov, et al.; and
WIPO Publication No. WO 2014/116896 of Morton, et al.

BACKGROUND OF THE DISCLOSURE

Modeling and numerical solution of miscible contamination cleanup may be performed in association with downhole sampling of fluid from a subterranean formation.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a method that includes operating a processing system comprising a processor and a memory to generate a proxy model by utilizing a true numerical model. The true model utilizes true model input parameters that include a pumping parameter descriptive of a pumpout time or volume of fluid to be obtained from a subterranean formation by a downhole sampling tool positioned in a wellbore extending into the subterranean formation, formation parameters descriptive of the subterranean formation, and a filtrate parameter descriptive of a drilling fluid utilized to form the wellbore. The output of the true model is contamination of the obtained fluid as a function of the pumping parameter. The proxy model utilizes proxy model input parameters each related to one or more of the true model input parameters. The output of the proxy model is the pumping parameter as a function of the contamination. Generating the proxy model includes (a) utilizing the true model to generate a plurality of true solutions for each of a plurality of different combinations of values of each of the plurality of true model input parameters, and (b) estimating fitting parameters of the proxy model utilizing the true solutions.

The present disclosure also introduces a method of evaluating performance of a downhole sampling tool in a formation traversed by a wellbore. The method includes generating a proxy model by utilizing a true numerical model of a downhole tool. The true model utilizes true model input parameters that include (i) a pumping parameter descriptive of a pumpout time or volume of fluid to be obtained from a subterranean formation by a downhole sampling tool positioned in a wellbore extending into the subterranean formation, (ii) formation parameters descriptive of the subterranean formation, and (iii) a filtrate parameter descriptive of a drilling fluid utilized to form the wellbore. The output of the true model is contamination of the obtained fluid as a function of the pumping parameter. The proxy model utilizes proxy model input parameters each related to one or more of the true model input parameters. The output of the proxy model is the pumping parameter as a function of the contamination. Generating the proxy model includes (i) utilizing the true model to generate true solutions for different combinations of values of each of the true model input parameters, and (ii) estimating fitting parameters of the proxy model utilizing the true solutions. The method also includes obtaining values of formation and filtrate input parameters representative of formation at a particular depth, and using the proxy model for the downhole tool and the values of the input parameters to evaluate performance of a downhole sampling tool by estimating pumpout time or volume required to reach desired contamination level of a sampled fluid at a particular depth in a formation. One or more aspects of the method are performed by one or more processing systems each comprising a processor and a memory.

The present disclosure also introduces a method of operating a processing system comprising a processor and a memory, including utilizing a proxy model to generate a pumping parameter as a function of contamination. The pumping parameter is descriptive of a pumpout time or volume of fluid to be obtained from a subterranean formation by a downhole sampling tool positioned in a wellbore extending into the subterranean formation. The contamination is a percentage of the fluid obtained by the downhole sampling tool that is not native to the subterranean formation. The proxy model is based on a true model. The true model utilizes true model input parameters that include the pumping parameter, formation parameters descriptive of the subterranean formation, and a filtrate parameter descriptive of a drilling fluid utilized to form the wellbore. The output of the true model is the contamination as a function of the pumping parameter. The proxy model utilizes proxy model input parameters each related to one or more of the true model input parameters.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
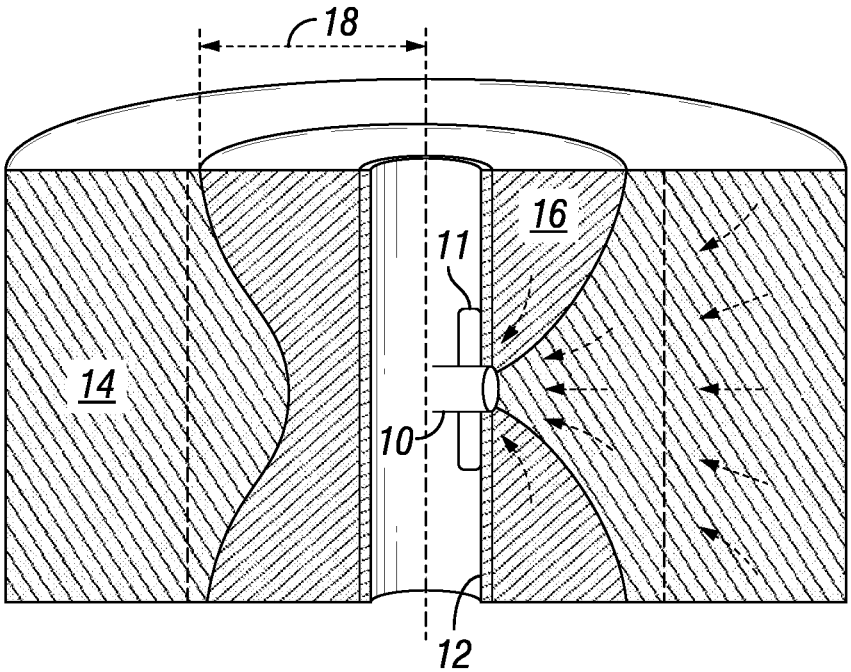
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure introduces one or more aspects related to parameterizing and/or approximating the solution to a mathematical model for miscible contamination cleanup, such as in relation to sampling of oil in a well drilled using oil-based drilling mud (OBM), sampling of water in a well drilled using water-based mud (WBM), and/or sampling of other subterranean formation fluids.

The present disclosure introduces methods to parameterize a mathematical model for miscible contamination cleanup for fluid sampling, approximate the model solution, and/or conduct sensitivity analyses for the input parameters, among other aspects. A low-dimensional parameterization may permit an accurate model approximation using, for example, a kriging-based proxy model. The resulting proxy model may be suitable for a variety of applications, including fast forward modeling in a tool planner workflow, as well as inverse modeling for design optimization, real-time contamination prediction, and/or closed-loop optimal control of the fluid sampling process, among other applications. The present disclosure also introduces a method that utilizes the proxy model to quantify uncertainty and identify the main sources of the uncertainty.

Downhole acquisition of fluid samples (oil, water, and/or gas) for pressure-volume-temperature (PVT) analysis using a wireline formation tester (WFT) is performed for characterizing and understanding a subterranean formation or reservoir. Knowledge of fluid type and properties may be utilized during planning of wells and surface facilities. The WFT may be equipped with one or more pumps, chambers for storing sampled fluid, and/or probes and/or packers that may be urged against a wellbore wall to establish hydraulic communication with the formation. However, oil-based mud (OBM) or water-based mud (WMB) may invade the formation during the wellbore drilling operations, thus contaminating the near-wellbore area of the formation, such that an initial or early phase of fluid sampling may include a cleanup operation to remove the contamination. Upon identification of clean formation fluid during continued pumping of fluid from the formation, the operation may switch from the cleanup phase to a sample collection phase, in which the formation fluid is diverted into one or more sample chambers of the downhole tool string, such as for subsequent fluid analysis after returning the downhole tool string to the wellsite surface. The combined cleanup and sampling operations at a single depth within the wellbore (station) may last for several hours. However, due to high rig costs, especially in offshore environments, and the risk of differential sticking of the downhole tool string, operators may seek to acquire the fluid samples as quickly as possible, while ensuring that the contamination level in the samples is sufficiently low (e.g., less than about five percent).

Accordingly, operators may perform pre-job modeling to predict cleanup times and/or select a downhole sampling tool suited for the given circumstances. For example, a three-dimensional (3D) numerical model may be utilized to describe the changing mixture of drilling fluid contamination and native formation fluid during the cleanup operation. The model may provide a prediction of the fraction of contaminant in the fluid pumped from the formation as a function of pumpout time or volume, thus permitting a prediction of the elapsed time at which a predetermined level of reduced contamination may be obtained. However, high-resolution 3D cleanup models may be computationally demanding and/or otherwise less practical for tool planner workflows, which may call for quickly evaluating multiple scenarios, such as may be due to inherent uncertainty in the formation and fluid properties.

In this context, the present disclosure introduces one or more aspects regarding approximating the numerical solutions in manners that may be both fast and accurate. The approximated solutions may then be utilized for comprehensive uncertainty analysis, such as may comprise global sensitivity analysis, and where causes of uncertainty in the predicted cleanup volume or time for a predetermined contamination level may be identified.

One or more aspects introduced in the present disclosure may find application in fast-forward modeling. For example, the proxy model described herein may be utilized to quickly evaluate parameter sensitivities, perform tool comparisons, and assess operational procedures, including where relevant to tool planner workflows and/or uncertainty quantification workflows, among other examples.

One or more aspects introduced in the present disclosure may also find application in inverse problems. For example, the proxy model described herein may be utilized in place of the true model in inverse modeling exercises, such as to speed up the optimization process. Examples may include tool design optimization and/or estimation of formation and/or fluid properties from observed cleanup data.

One or more aspects introduced in the present disclosure may also find application in real-time contamination monitoring. For example, in an application of inverse problems, as described above, the proxy model described herein may be utilized for real-time contamination monitoring by on-the-fly inversion for formation and/or fluid parameters from observed optical fluid analyzer data, and/or subsequent prediction of the cleanup time/volume remaining to reach a predetermined level of contamination.

One or more aspects introduced in the present disclosure may also find application in closed-loop optimal control of the sampling process. For example, in a combination of the above-described inverse problems and real-time contamination monitoring, the proxy model described herein may be utilized in closed-loop optimal control of the sampling process by observing contamination levels and computing real-time operational adjustments, such as changing of pump rates and/or changing of guard/sample flow split ratios for focused tools, among other examples.

One or more aspects introduced in the present disclosure pertain to the parameterization of a miscible fluid contamination cleanup model by a small (or the smallest possible) parameter set that is as complete as possible, such as parameterization that captures the variation in eight physical parameters of the contamination cleanup in three non-dimensional parameters. Such aspects may dimensionally reduce parameter space, which may facilitate the proxy model construction. One or more aspects introduced in the present disclosure may also or instead pertain to the application of kriging-based interpolation for proxy model construction, such as may be based on the parameterization described above. One or more aspects introduced in the present disclosure may also or instead pertain to the quantification of uncertainty and identification of contributors to uncertainty in the model predictions of cleanup volume and/or time.

The following description regards an example implementation of model parameterization for proxy model construction according to one or more aspects of the present disclosure.

The miscible contamination cleanup process with respect to a WFT probe may be modeled as single-phase flow with contaminant transport, as set forth below in Equations (1)-(6).

$$\frac{\partial(\varphi\rho)}{\partial t} + \nabla\cdot(\rho u) = 0 \tag{1}$$

$$\frac{\partial(\varphi\rho w)}{\partial t} + \nabla\cdot(\rho w u) = 0 \tag{2}$$

$$u = -\frac{k}{\mu}(\nabla P - \rho g \nabla Z) \tag{3}$$

$$\rho = \rho^o e^{c_f(P-P^o)} \tag{4}$$

$$\varphi = \varphi^o e^{c_r(P-P^o)} \tag{5}$$

$$\mu = w\mu_{mf} + (1-w)\mu_o \tag{6}$$

where $\varphi$ is porosity, $\rho$ is fluid mixture density, t is pumpout time, $\nabla$ is a differential operator, u is a vector of velocities, Q is pump rate, w is contaminant mass fraction, k is a permeability tensor, $\mu$ is mixture viscosity, P is pressure, g is a vector of gravitational acceleration, Z is reservoir depth, $\rho^0$ is density at reference pressure, e is the mathematical constant (base of the natural logarithm), $c_f$ is fluid compressibility, $P^0$ is reference pressure, $\varphi^0$ is porosity at reference pressure, $c_r$ is rock compressibility, $\mu_{mf}$ is contaminant (mud filtrate) viscosity, and $\mu_0$ is formation fluid viscosity. A linear mixing rule is suggested in Equation (6) for the mixture viscosity, but other mixing rules may also be used within the scope of the present disclosure.

A vertical well may be assumed in a non-dipping formation. FIG. 1 depicts an example schematic of mud filtrate contamination cleanup with a WFT probe 10, demonstrating an example radial model that may be utilized. The outer boundaries are closed and located far away from the wellbore. The upper and lower boundaries are also closed and located away from the WFT probe 10, such that boundary effects do not impact the cleanup process. Mudcake 12 may be assumed to be sealing against the packer 11 of the WFT probe 10, such that no invasion may be taking place during the cleanup. A fixed rate or fixed drawdown boundary condition may be utilized at the interface between the probe 10 and the formation 14. Properties of the formation 14 may be assumed to be homogeneous but anisotropic. The mud filtrate 16 may be assumed to invade the formation 14 in a uniform, piston-like manner, and the depth 18 of filtrate 16 invasion may be treated as an input to the model. Example fluid, formation, and geometric parameters are summarized in Table 1, set forth below.

TABLE 1

Example Model Input Parameters

| Parameter | Symbol | Unit |
|---|---|---|
| Porosity | $\varphi$ | — |
| Absolute Horizontal Permeability | $K_h$ | milliDarcy (mD) |
| Permeability Anisotropy | $K_v/K_h$ | — |
| Formation Fluid Viscosity | $\mu_o$ | centipoise (cP) |
| Mud Filtrate Viscosity | $\mu_{mf}$ | cP |
| Depth of Filtrate Invasion | DOI | inches (in) |
| Wellbore Diameter | $D_w$ | In |
| Total Pump Rate | Q | cubic centimeters/second (cc/s) |

The symbol $K_v$ is for absolute vertical permeability, but may be excluded from the model input parameters because $K_h$ and $K_v/K_h$ are known. It is also noted that parameters such as fluid density and compressibility are not included in Table 1 because these parameters generally do not affect miscible contamination cleanup behavior when varied within common ranges for oil sampling in OBM or water sampling in WBM.

The model represented by Equations (1)-(6) set forth above can be solved numerically by discretization in time and space. This process of numerical solution is well known in the field, and various discretization techniques and simulation codes may be utilized within the scope of the present disclosure, such as the commercial reservoir simulator ECLIPSE. In the context of the application of kriging-based interpolation for proxy model construction, the above model and its numerical solution are referred to as the true model and true solution, respectively. It is thus understood that the true solution may be a converged numerical solution, in the sense that it may be computed on a sufficiently fine grid and using sufficiently fine time intervals such that numerical approximation errors do not affect the solution.

The output from the true model may include the fraction of contaminant in the pumped formation fluid as a function of the pumped volume or, assuming a substantially constant pump rate, as a function of pumping time. For the proxy modeling, the pumped volume $V_p$ is expressed as a function of the contaminant concentration and a vector or parameters, as set forth below in Equation (7).

$$V_p = V_p(w;p) \tag{7}$$

where p is the vector of parameters, such as permeability, porosity, and/or others.

Figure 2:
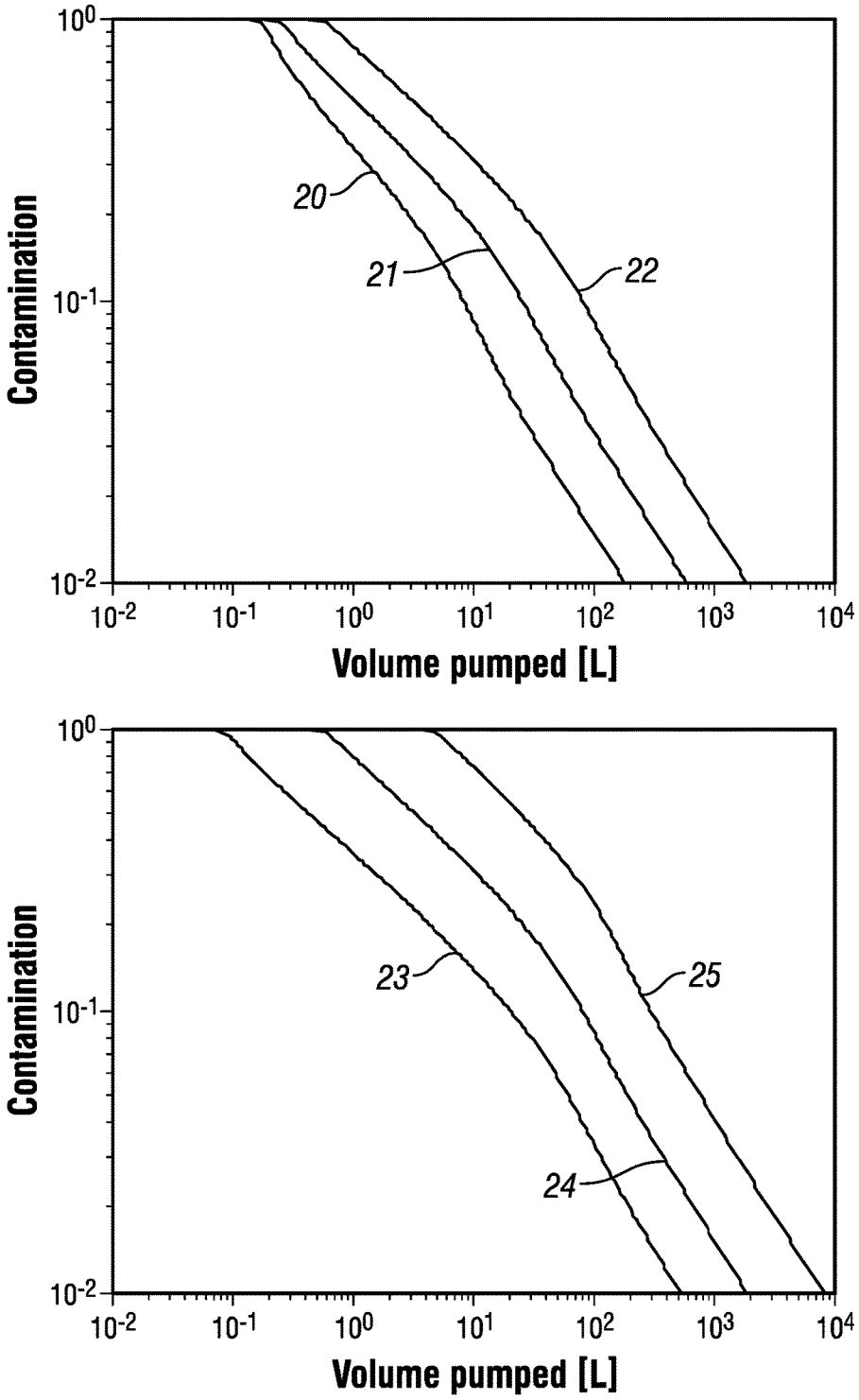
FIG. 2 contains two graphs depicting one or more aspects of the present disclosure.

FIG. 2 includes two graphs depicting example miscible contamination cleanup curves for fluid sampling with a WFT probe, in which $\varphi=0.10$, $K_h=10$ mD, $\mu_{mf}=\mu_0=1$ cP, $D_w=8.5$ in, and Q=10 cc/s. In the first (top) graph, DOI=4 inches (10.2 centimeters) and $K_v/K_h$, varies, including a curve 20 for $K_v/K_h=0.01$, a curve 21 for $K_v/K_h=0.10$, and a curve 22 for $K_v/K_h=1.00$. In the second (bottom) graph, $K_v/K_h=1$, and DOI varies, including a curve 23 for DOI=2 inches (5.1 cm), a curve 24 for DOI=4 inches (10.2 cm), and a curve 25 for DOI=8 inches (20.3 cm).

The proxy model is utilized to approximate the functional relationship between the pumped volume and the contaminant concentration over relevant ranges for the associated parameters.

The parameters in Table 1 set forth above are the actual physical parameters, but they do not affect the cleanup behavior independently. Thus, for the purpose of proxy model construction, the parameter set can be reduced. That is, the cleanup behavior can be considered governed by the dimensionless parameters set forth below in Equations (8)-(10).

$$\delta = \frac{DOI}{D_w} \tag{8}$$

$$\bar{\mu} = \frac{\mu_o}{\mu_{mf}} \tag{9}$$

$$\bar{K} = \frac{K_v}{K_h} \tag{10}$$

where $\delta$ is dimensionless invasion depth, $D_w$ is diameter of the wellbore, $\bar{\mu}$ is fluid viscosity ratio, and $\bar{K}$ is permeability anisotropy.

In addition, for fixed values of the dimensionless parameters, the relations set forth below in Equations (11)-(14) hold.

$$V_p(\varphi^a) = V_p(\varphi^b)\frac{\varphi^a}{\varphi^b} \tag{11}$$

$$V_p(D_w^a) = V_p(D_w^b)\cdot\left(\frac{D_w^a}{D_w^b}\right)^3 \tag{12}$$

$$V_p(Q^a) = V_p(Q^b) \tag{13}$$

$$V_p(M^a) = V_p(M^b),\ M = \frac{K_h}{\mu} \tag{14}$$

where $\varphi^a$ and $\varphi^b$ denote two values of porosity, $D_w{}^a$ and $D_w{}^b$ denote two values of wellbore diameter, $Q^a$ and $Q^b$ denote two values of pump rate, and $M^a$ and $M^b$ denote two values of fluid mobility.

Thus, cleanup volume is not affected by mobility and pump rate, and the effects of porosity and wellbore diameter can be accounted for by simple volume corrections. Accordingly, while the proxy model may internally address variations in just the three non-dimensional parameters, it may be utilized to predict the behavior for the entire set of parameters, such as set forth above in Table 1.

It is also noted that, while the model parameterization presented above is specific to the kind of model utilized for the miscible contamination cleanup process, the approximation based on kriging interpolation described below may also be utilized for other types of cleanup models. For example, the model may be extended to include the effects of reservoir thickness, tool proximity to a bed boundary, and/or wellbore inclination, among other examples, such as by including additional parameters in the minimal complete parameter set.

The following description regards an example implementation of proxy modeling for miscible contamination cleanup according to one or more aspects of the present disclosure.

As described above, one or more aspects introduced in the present disclosure may pertain to the application of kriging-based interpolation to construct a proxy model for miscible contamination cleanup behavior. The kriging-based proxy model may be expressed as set forth below in Equation (15).

$$\hat{V}_p(p) = \alpha^T\Phi(\theta,p) + \beta^T f(p) \tag{15}$$

where $\hat{V}_p$ denotes the kriging prediction of pumped volume at a given level of contamination, p denotes the vector of input parameters, T is the transpose operator, f(p) denotes a regression part of the model that includes low-order polynomials and that accounts for a global trend in the modeled data, $\Phi(\theta, p)$ denotes a correlation part of the model, and $\alpha$ and $\beta$ denote kriging model parameters that may be estimated by fitting the responses from the true model.

It may be assumed that m true model responses are given, which may be expressed as set forth below in Equation (16).

$$\{(p_i, y_i = V_p(p_i))\}_{i=1}^m \tag{16}$$

where $y_i$ is the $i^{th}$ of m true model responses utilizing the vector of input parameters p.

That is, the true model is evaluated in m different points in the parameter space. The regression (f(p)) and correlation ($\Phi(\theta, p)$) functions may be expressed as set forth below in Equations (17) and (18).

$$f(p) = [f_1(p), \ldots, f_q(p)]^T \tag{17}$$

$$\Phi(\theta,p) = [\Phi_1(\theta,p), \ldots, \Phi_m(\theta,p)]^T \tag{18}$$

where $\Phi_i(\theta, p) = \Phi_i(\|\Theta(p-p_i)\|_2)$ and $\Theta = \mathrm{diag}(\theta_1, \ldots, \theta_d)$. Thus, the correlation function $\Phi(\theta, p)$ is a function of the distance between the points in which the true model was evaluated, $p_i$, and the current point of interest, p. The vector $\theta$ denotes scaling parameters that govern the correlation lengths in each of the parameter directions. Several different functional forms for the correlation functions were tested, and a Gaussian function of the form set forth below in Equation (19) was found to give satisfactory results. However, other Gaussian, exponential, spline, and/or other correlation functions may also be utilized within the scope of the present disclosure.

$$\Phi_i = \exp(-\|\Theta(p-p_i)\|_2{}^2) \tag{19}$$

For the regression functions f(p), the use of second order polynomials was found to give satisfactory results, as measured by the mean prediction error when validating the proxy model against true model responses not used during the proxy construction.

In the following description, the application of kriging-based proxy modeling to miscible contamination cleanup is demonstrated through an example cleanup using a WFT probe.

The true model may initially be evaluated at selected points in the parameter space to generate the true solutions to which the proxy model will be fitted. Example parameter ranges of interest are set forth below in Table 2.

TABLE 2

Minimum and Maximum Values and Assumed Distributions of Governing Parameters for Experimental Design

| Parameter | Symbol | Minimum Value | Maximum Value | Probability Density Function (PDF) |
|---|---|---|---|---|
| Permeability Anisotropy | $\overline{K}$ | 0.01 | 100 | Log-uniform |
| Viscosity Ratio | $\overline{\mu}$ | 0.1 | 100 | Log-uniform |
| DOI/$D_w$ | $\delta$ | 0.235 | 3.765 | Uniform |

It is noted that the minimum and maximum values in the examples of Table 2 correspond to a DOI ranging between about 2 inches (5.1 cm) and about 32 inches (81.3 cm) for a wellbore having a diameter of about 8.5 inches (21.6 cm).

Figure 3:
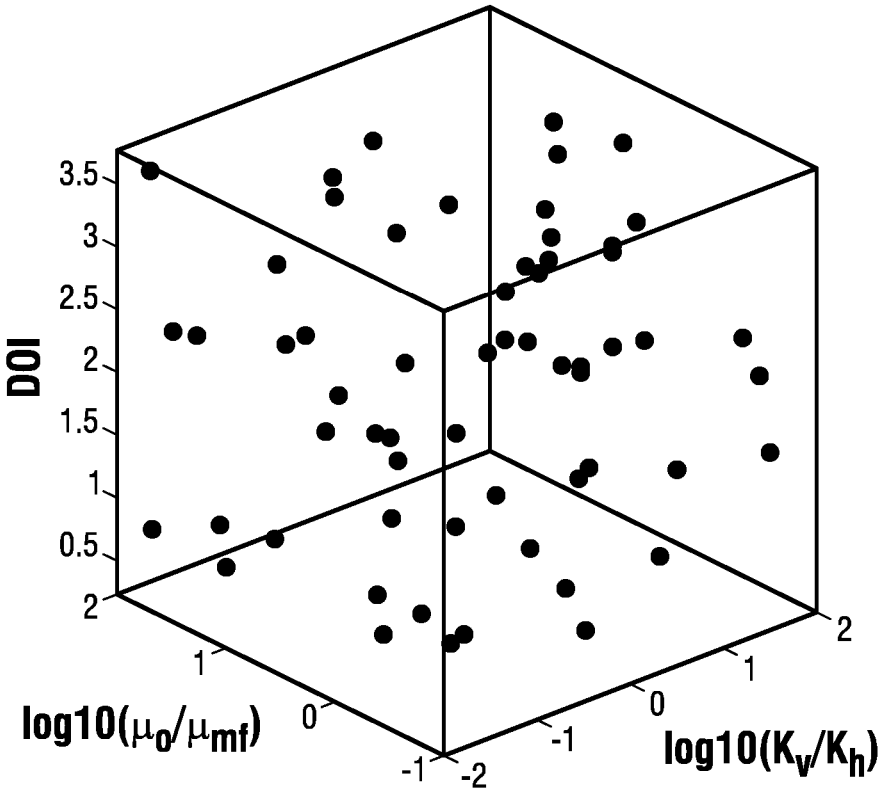
FIG. 3 is a graph depicting one or more aspects of the present disclosure.

A Latin Hypercube experimental design may be utilized to randomly select sixty (for example) parameter combinations, as shown in FIG. 3. However, other space filling experimental designs and/or different sample sizes may also or instead be utilized within the scope of the present disclosure.

Upon evaluation of the true model, the proxy model coefficients may be fitted by enforcing conditions by which the proxy model honors the true solutions. The methodology for fitting the coefficients is known in the art. Improved proxy accuracy may be obtained by utilizing a logarithmic transform prior to fitting the proxy, such that the actual proxy model may express the relationship between the logarithm of pumped volume/time and the input parameters (such as permeability anisotropy, viscosity ratio, and dimensionless depth-of-invasion).

Figure 4:
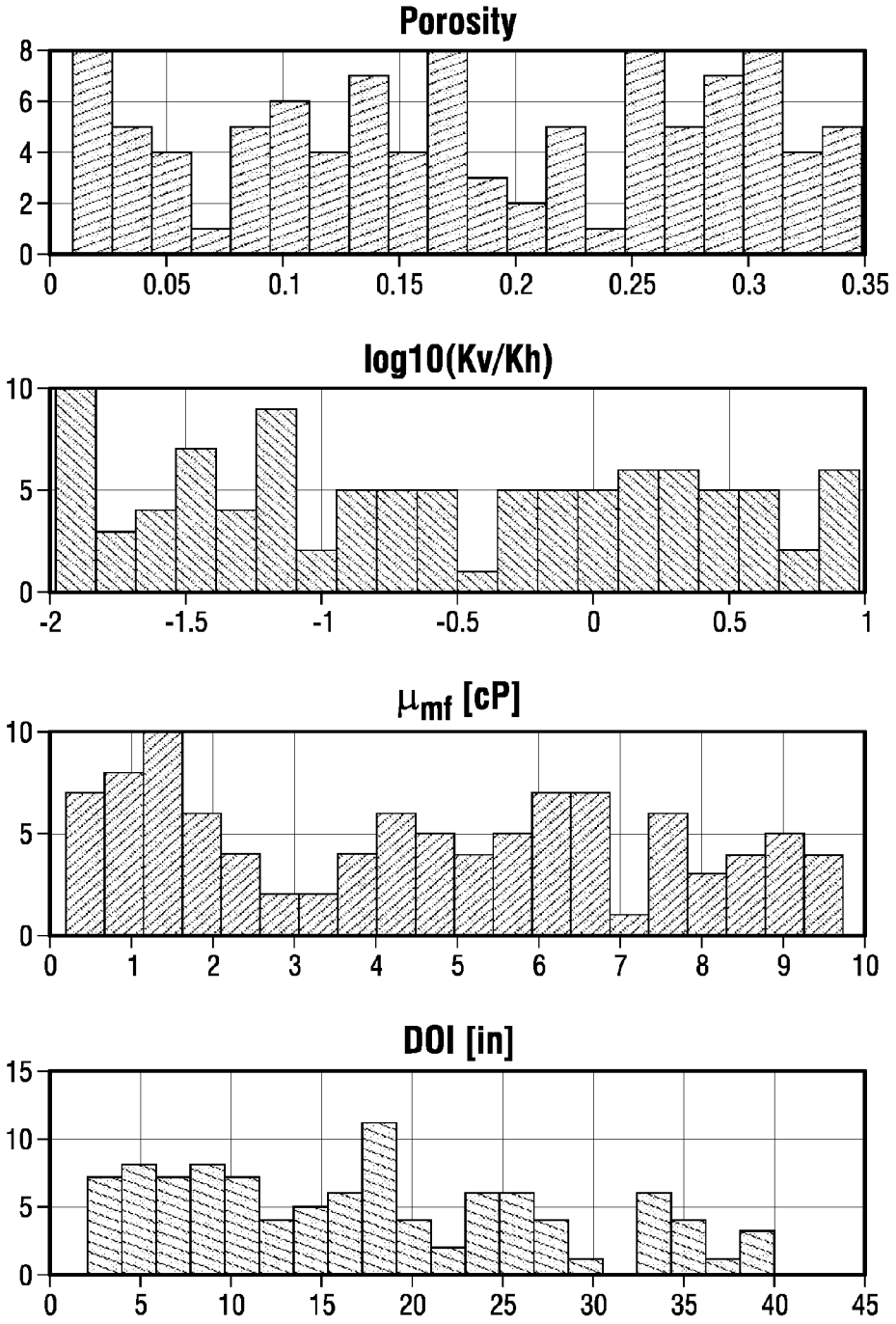
FIG. 4 contains eight graphs depicting one or more aspects of the present disclosure.
Figure 4:
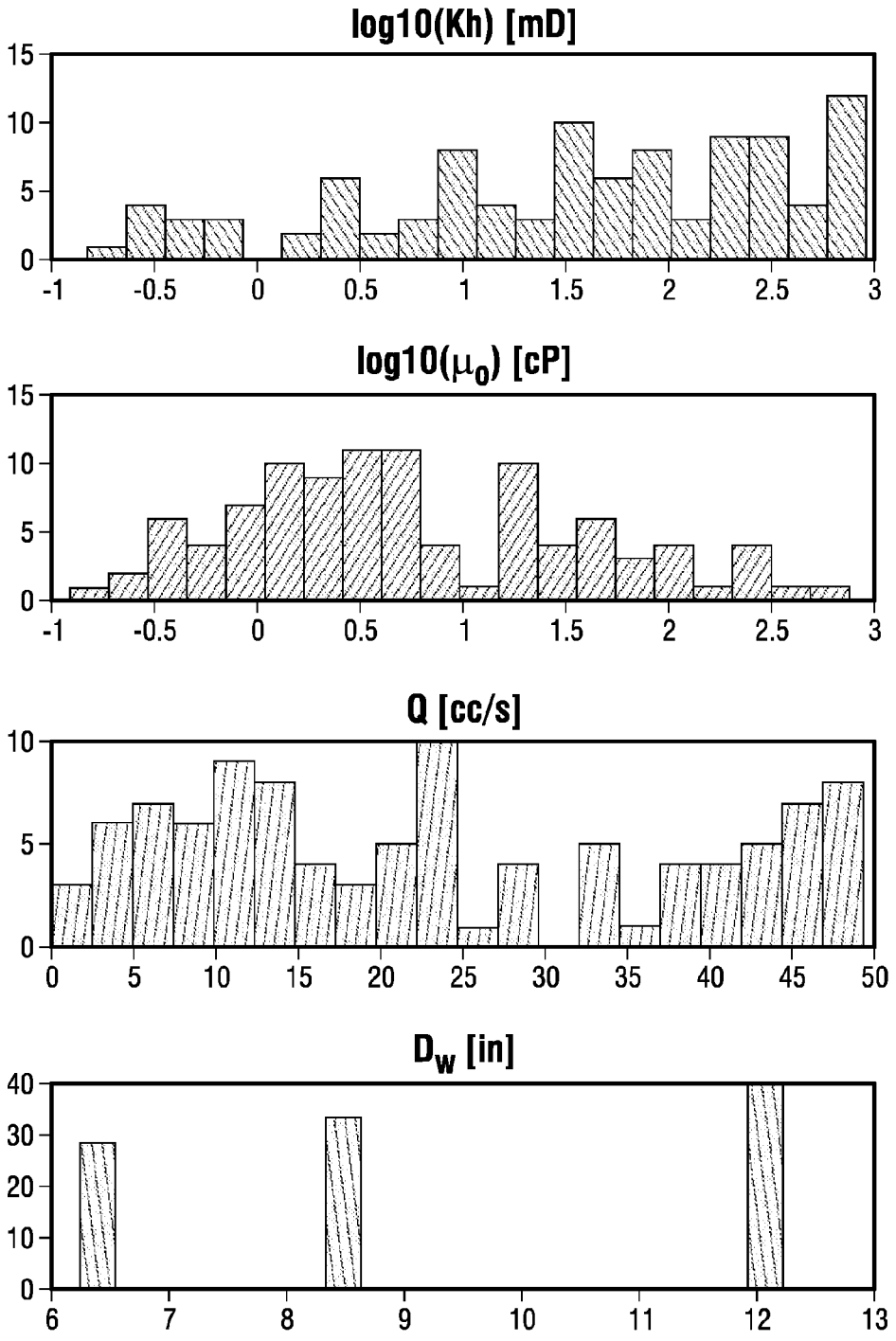

The quality of the proxy model may be evaluated by validating the accuracy of its predictions for input parameter combinations not used when fitting the proxy coefficients. This validation step may also aid in validating the model parameterization by sampling in the original parameters (such as set forth above in Table 1) and evaluating the true model response using these parameters. Table 3, set forth below, lists example ranges and distributions that may be used for generating 100 random parameter combinations for which the true model is evaluated. Histograms for the 100 validation parameter sets are shown in FIG. 4.

TABLE 3

Example Parameter Ranges/Distributions

| Parameter | Unit | Min. Value | Max. Value | PDF |
|---|---|---|---|---|
| Porosity | — | 0.01 | 0.35 | Uniform |
| Absolute Horizontal Permeability | mD | 0.1 | 1000 | Log-uniform |
| Permeability Anisotropy | — | 0.01 | 100 | Log-uniform |
| Formation Fluid Viscosity | cP | 0.1 | 1000 | Log-uniform |
| Mud Filtrate Viscosity | cP | 0.2 | 10 | Uniform |
| Filtrate Invasion Depth | in | 2 | 60 | Uniform |
| Wellbore Diameter | in | 6.25 | 12.25 | Uniform |
| Total Pump Rate | Cc/s | 0.1 | 50 | Uniform |

Accuracy of the proxy model may be most relevant in the low contamination range (such as less than about twenty percent), approaching the pumpout volume/time where fluid sample collection is initiated. The relative error in the proxy prediction of the pumped volume at five percent contamination may thus be utilized as a measure of proxy accuracy, as set forth below in Equation (20).

$$\text{Error} = \frac{|V_p - \widehat{V_p}|}{V_p} \cdot 100\% \tag{20}$$

Figure 5:
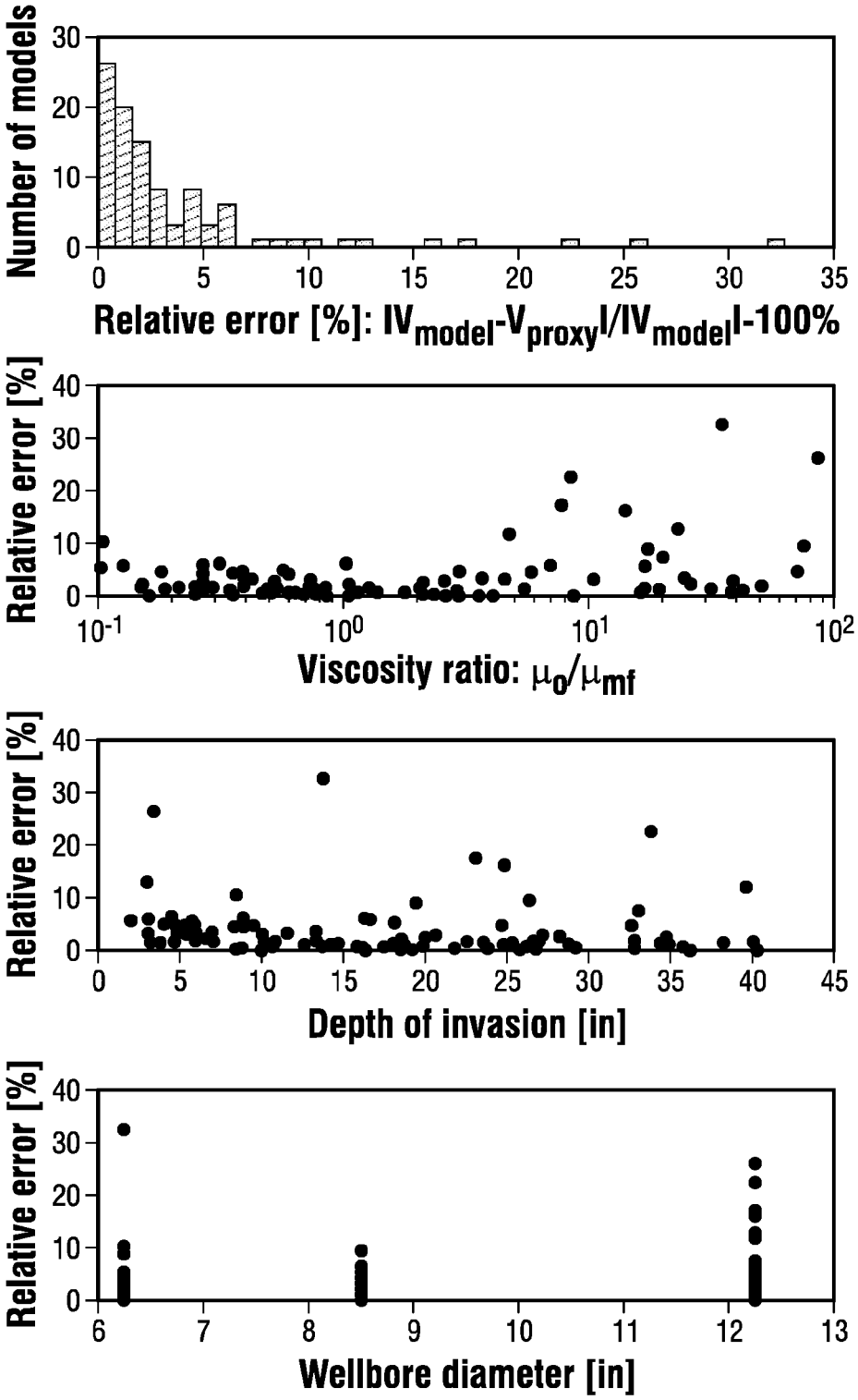
FIG. 5 contains eight graphs depicting one or more aspects of the present disclosure.
Figure 5:
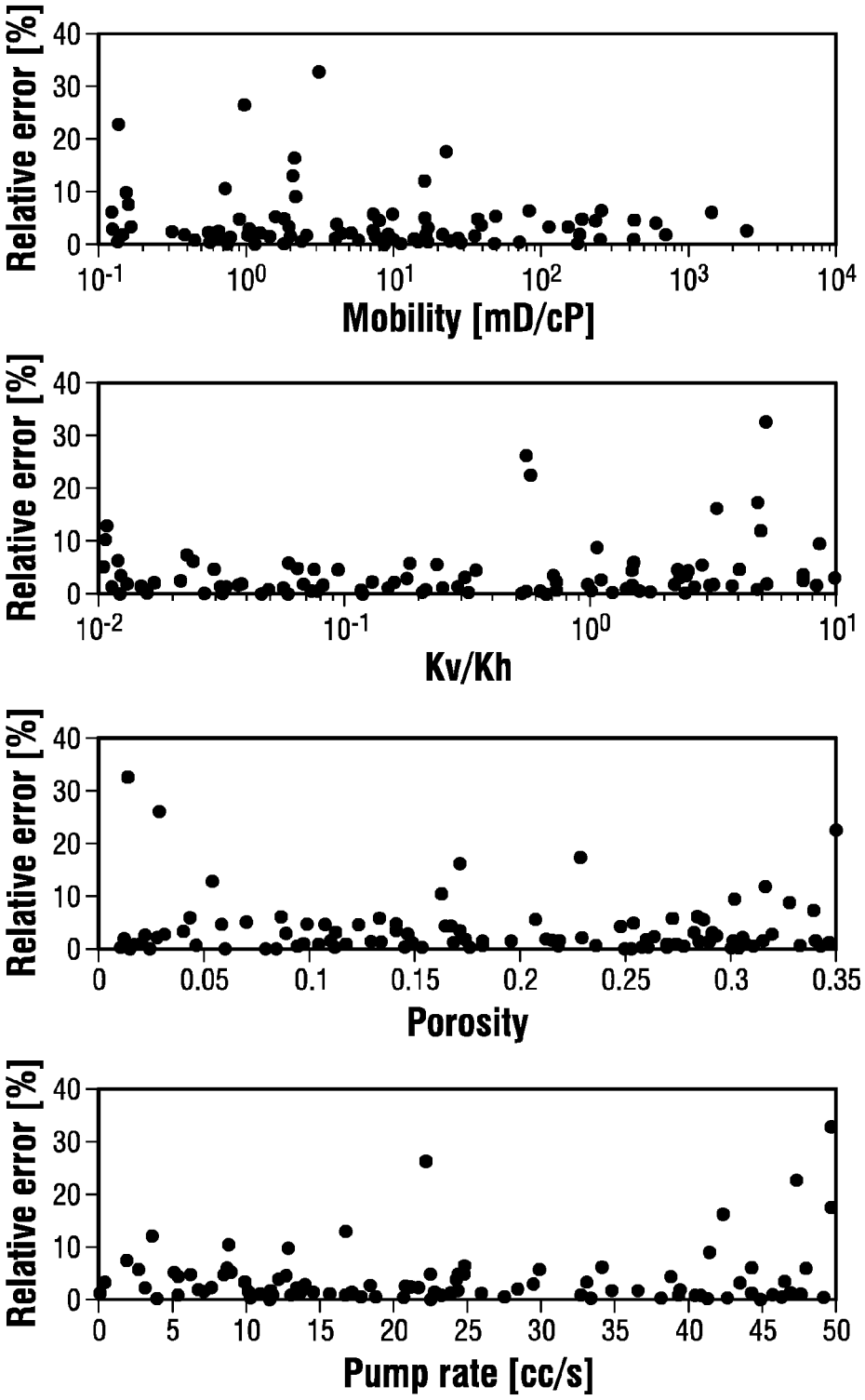

FIG. 5 shows the relative proxy error in comparison with the 100 validation models described above. The errors are plotted against the input parameters to identify possible correlation patterns. It is observed that the proxy is able to predict the cleanup volume with almost uniform accuracy across the parameter space. The mean relative error is about 3.7 percent, which may be deemed to be within acceptable levels. Given the uncertainty of the input parameters in a forward model prediction of cleanup volume, the small additional approximation error introduced by the proxy model may be considered insignificant, and the proxy model may therefore be utilized in place of the true model, provided that it is used within the parameter ranges where it has been validated.

Figure 6:
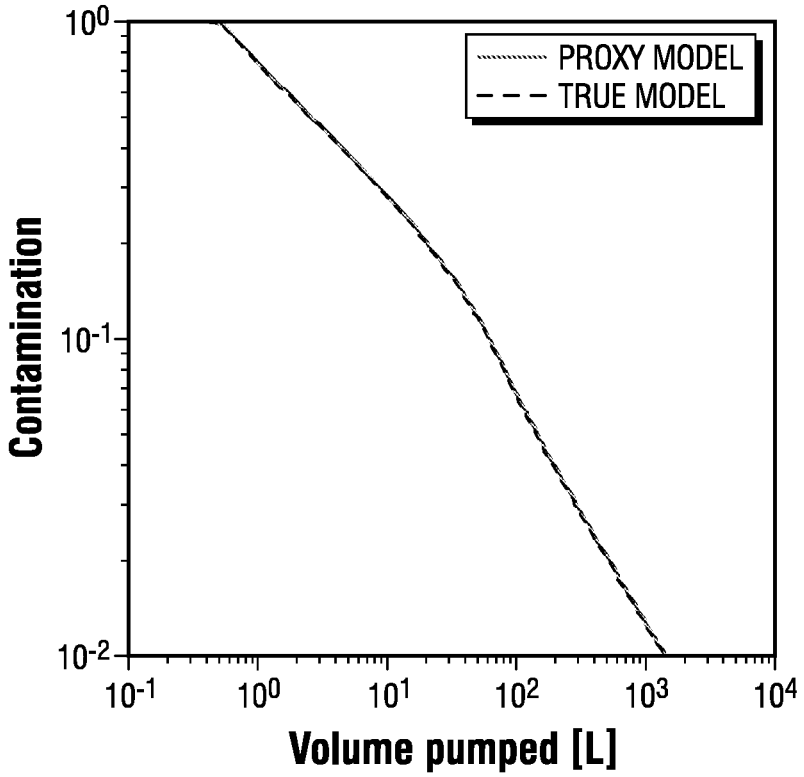
FIG. 6 contains two graphs depicting one or more aspects of the present disclosure.
Figure 6:
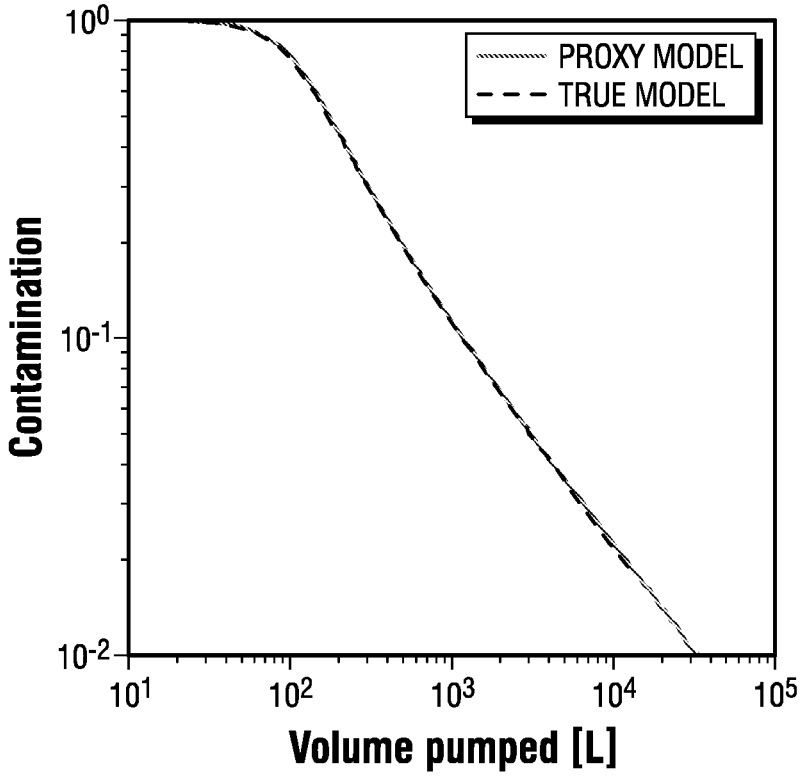

Example comparisons of proxy predictions and true model solutions are shown in FIG. 6 for two cases: a low-porosity, low-permeability case with deep invasion and significant viscosity contrast, and a high-porosity, high-permeability case with shallow invasion. That is, FIG. 6 includes two graphs, a first graph (on the left) in which $\varphi$=0.35, $K_h$=1000 mD, $K_v/K_h$=0.2, $\mu_0$=1 cP, $\mu_{mf}$=1 cP, DOI=4 in, and $D_w$=8.5 in, and a second graph (on the right) in which $\varphi$=0.10, $K_h$=3 mD, $K_v/K_h$=0.1, $\mu_0$=10 cP, $\mu_{mf}$=1 cP, DOI=20 in, and $D_w$=8.5 in. Substantial agreement is observed. At a contamination level of about five percent, the proxy error in both cases is less than about one percent compared to the true solution.

It is noted that, while the examples presented in this section of the disclosure concern proxy modeling of the cleanup behavior of a WFT probe, the methodology presented for proxy model construction may also be applicable or readily adaptable to cleanup by dual-packers, single-packers with multiple discrete fluid drains, as well as focused probes and packers.

The following description regards an example implementation of tool planner workflow and global sensitivity analysis according to one or more aspects of the present disclosure.

Multiple scenarios for sampling job designs may be considered during operations encountering incomplete data and/or uncertainty in reservoir and/or fluid properties. The constructed proxy model may be utilized to explore and evaluate these scenarios in almost real-time, such as by one or more of the following. First, given the available data about the reservoir, the ranges for uncertain input parameters may be sampled (perhaps exhaustively) according to assigned probability distributions. Second, statistical estimates (e.g., P05-P50-P95) for the cleanup volume pumped to reach a predetermined contamination level may be obtained utilizing the proxy model. Third, the uncertainty in the obtained estimates for the cleanup volume may be expressed via predetermined quantile ranges (e.g., P05-P95) or via standard deviation.

Figure 7:
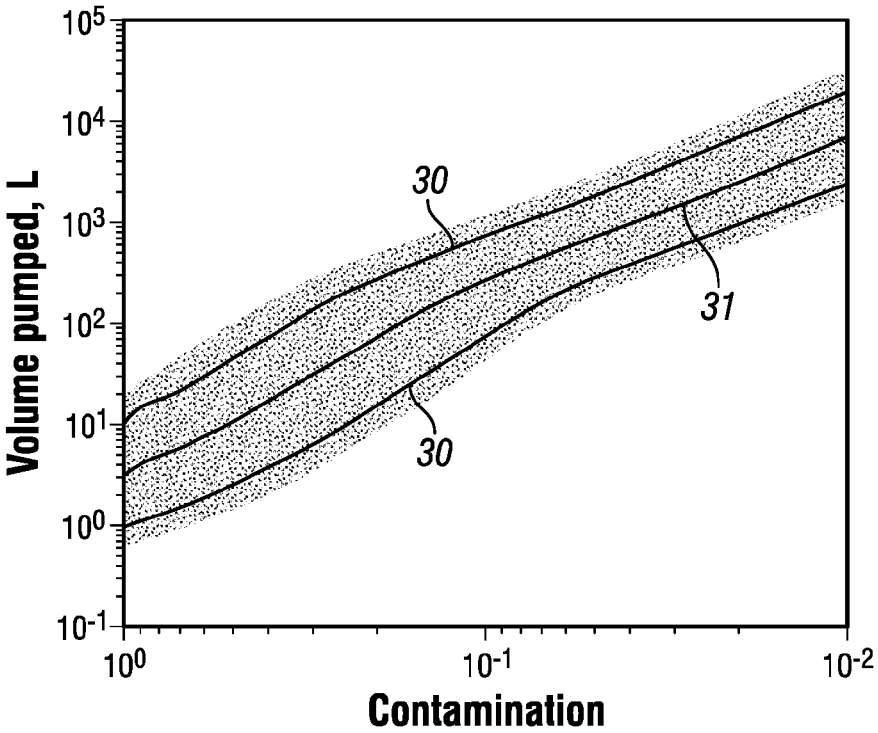
FIG. 7 contains two graphs depicting one or more aspects of the present disclosure.
Figure 7:
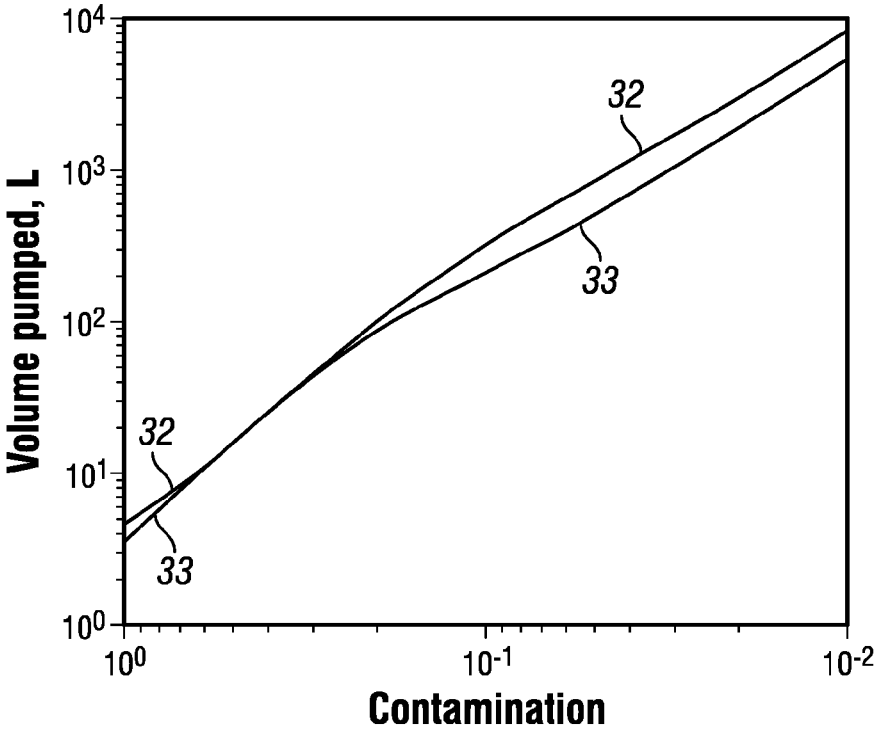

FIG. 7 depicts example cleanup volumes as a function of contamination level, illustrating uncertain shallow invasion due to high viscosity of the filtrate and relatively low horizontal permeability. Parameter ranges utilized in the examples of FIG. 7 include $\varphi$=[0.15; 0.25], $K_v/K_h$=[1; 10], $\mu_0/\mu_{mf}$=[0.1; 1], DOI=[5 in; 10 in], and $D_w$=8.5 in. FIG. 7 includes two graphs. The first graph (on the left) depicts results of 2000 proxy model realizations, with a P05-P95 envelope (lines 30) and a P50 curve (line 31). The second graph (on the right) depicts mean value (line 32) and standard deviation (line 33) of the cleanup volume.

In the examples of FIG. 7, the parameter ranges were assigned to represent an uncertain shallow invasion due to high filtrate viscosity and a relatively dominant vertical permeability. As shown in FIG. 7, for a contamination level of about five percent, the standard deviation of $V_p$ is close to 400 L, translating to more than eleven hours of cleanup time at a pump rate of about 10 cc/s. Given the high costs of rig operation, this uncertainty may be prohibitive in making a conclusive decision on the value and/or demand of a sampling job.

Therefore, a systematic approach may be utilized to (1) quantify and rank the main contributions to this uncertainty from the input parameters, and (2) suggest a targeted measurement program to reduce uncertainty in the identified parameters, such that the uncertainty in the predicted cleanup volume may be reduced as much as possible.

Sensitivity analysis generally quantifies the significance of input parameters in computing model predictions. In the presence of uncertainty, it may be instructive to examine a global sensitivity analysis (GSA) that quantifies the relation between uncertainties in the input parameters and uncertainty in the model outcome. Unlike traditional sensitivity analyses, such as may be based on local partial derivatives, GSA relies on variance decomposition into terms with increasing dimensionality, and explores the entire input parameter domain. This may be of particular concern for the analysis of nonlinear and non-monotonous phenomena, such as miscible cleanup processes considered in this disclosure, where traditional correlation-based methods and other commonly used approaches (such as one-at-a-time) may not be applicable.

GSA can be applied in a general problem setting with a set of uncertain input parameters, a model, and a corresponding set of model predictions. For example, let the uncertainty in the prediction of the model for Y be characterized by its variance V(Y), therefore assuming that the variance is an adequate representation of the uncertainty in Y. This assumption is often valid except for highly asymmetric probability distributions of Y. The contributions to V(Y) due to the uncertainties in the input parameters $\{X_i\}$ may then be estimated.

For independent $\{X_i\}$, the Sobol' variance decomposition can be utilized to represent V(Y), as set forth below in Equation (21)

$$V(Y)=\Sigma_{i=1}^{N}V_i+\Sigma_{1\le i<j\le N}V_{ij}+\ldots+V_{12\ldots N} \tag{21}$$

where $V_i=V[E(Y|X_i)]$ are the variance in conditional expectations (E) of Y when $X_i$ is fixed, (e.g., $V(X_i)=0$). Thus, $V_i$ represent first-order contributions to the total variance V(Y). Since the true value of $X_i$ is not known a priori, the expected value of Y when $X_i$ is fixed (within its possible range) may be estimated, while the rest of the input parameters $\{X_{i-1}\}$ may be varied according to their original probability distributions. Thus, Equation (22) set forth below is an estimate of the relative reduction in total variance of Y if the variance in $X_i$ is reduced to zero.

$$S1_i=V_i/V(Y) \tag{22}$$

Similarly, $V_{ij}=V[E(Y|X_i, X_j)]-V_i-V_j$ is the second-order contribution to the total variance V(Y) due to interaction between $X_i$ and $X_j$. The estimate of variance when both $X_i$ and $X_j$ are fixed simultaneously may be corrected for individual contributions $V_i$ and $V_j$.

For additive models Y(X), the sum of the first-order effects $S1_i$ is equal to 1. This is not applicable for the general case of non-additive models, where second, third, and higher-order effects (e.g., interactions between two, three, or more input parameters) play a not unsubstantial role. The contribution due to higher-order effects may be estimated, however, via the total sensitivity index ST, as set forth below in Equation (23).

$$ST_i=\{V(Y)-V[E(Y|X_{-i})]\}/V(Y), \tag{23}$$

where $V(Y)-V[E(Y|X_{-i})]$ is the total variance contribution from the terms in variance decompositions that include $X_i$. It is also noted that $ST_i \ge S1_i$, and the difference between the two represents the contribution from the higher-order interaction effects that include $X_i$.

There are several methods available to estimate $S1_i$ and $ST_i$. For example, one may utilize an algorithm developed by Saltelli that further extends a computational approach proposed by Sobol' and Homma and Saltelli. The computational cost of calculating both $S1_i$ and $ST_i$ is N(k+2), where k is a number of input parameters and N is a number of model evaluations large enough (such as between 1,000 and 10,000) to obtain an accurate estimate of conditional means and variances. With the computationally expensive true model replaced by an accurate and fast proxy model, the computational cost of GSA may become negligible.

Figure 8:
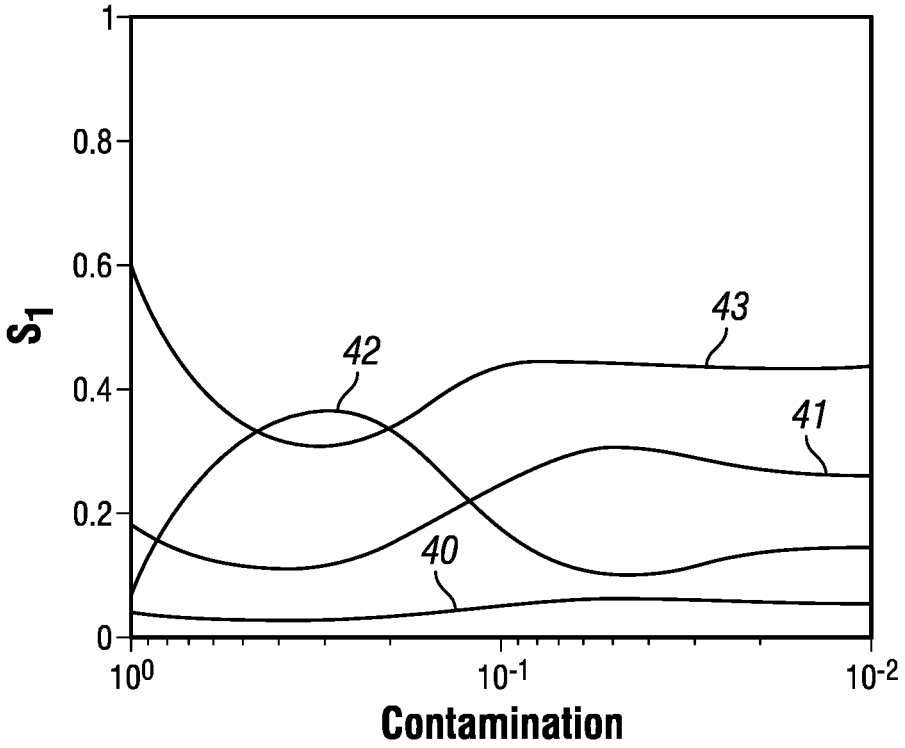
FIG. 8 contains two graphs depicting one or more aspects of the present disclosure.
Figure 8:
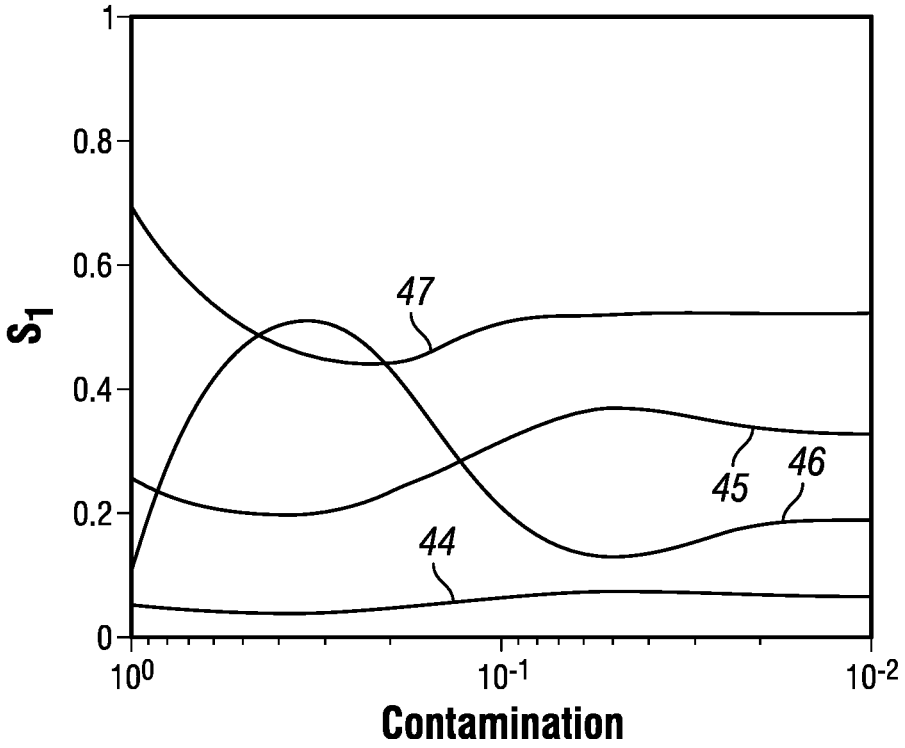

FIG. 8 presents an example of an answer product showing first-order and total sensitivity indices calculated for uncertain shallow invasion due to high viscosity of the filtrate and low $k_h$ for the case introduced above in FIG. 7. That is, FIG. 8 includes two graphs, a first graph (on the left) for first order sensitivity indices and a second graph (on the right) for total sensitivity indices, representing relative contributions from four uncertain input parameters to the total variance of predicted cleanup volume as a function of contamination level. The first order sensitivity indices in the first graph include porosity (curve 40), $K_v/K_h$ (curve 41), $\mu_0/\mu_{mf}$ (curve 42), and DOI (curve 43), and the total sensitivity indices in the second graph include porosity (line 44), $K_v/K_h$ (curve 45), $\mu_0/\mu_{mf}$ (curve 46), and DOI (curve 47). In the example of FIG. 8, N=2000 and k=4. The input parameter space is sampled with Sobol' quasi-random $LP_\tau$ sequences, which were expected to outperform Latin Hypercube sampling and Latin supercube sampling in calculating first-order and total sensitivity indices.

Based on the first-order sensitivity indices shown in FIG. 8 (on the left), for low contamination levels (e.g., below about ten percent), uncertainty in depth of invasion contributes at least 45% to the variance of the cleanup volume $V_p$. At about five percent contamination level, uncertainty in $K_v/K_h$ is responsible for about thirty percent of the variance in $V_p$. Given the standard deviation of $V_p$ at 400 L (for about five percent contamination), an accurate measurement of depth of invasion may reduce uncertainty in the cleanup time by almost one third (from about eleven hours to about eight hours) for an assumed pump rate of about 10 cc/s. An accurate measurement of $K_v/K_h$ may result in reducing the estimated standard deviation of cleanup time from about 11.1 hours to about 9.3 hours. If both main contributors are accurately determined through targeted measurements, the standard deviation in cleanup time may be reduced to about 5.5 hours.

The interpretation of total sensitivity indices shown in FIG. 8 (on the right) may provide guidance on possible dimensionality-reduction of the forward and inverse model.

Even with a relatively wide range of porosity values in this example, its overall contribution to the variance of $V_p$ does not exceed about seven percent. In one implementation, low values of ST (e.g., below about five percent) for a particular input parameter may suggest that this parameter may be fixed anywhere within its range without significantly affecting estimates and uncertainty analysis for the cleanup model with reduced set of input parameters. Given continuous monitoring of the contamination level, depth of invasion, $K_v/K_h$ and $\mu_0/\mu_{mf}$ may be inverted, with corresponding values of $ST_i$ providing the weights in the gradient function. Note that the weighting scheme becomes a function of the observed contamination level, such as with the viscosity ratio weighted higher than the permeability ratio for high contamination levels (e.g., greater than about ten percent), but substantially lower for low contamination levels (e.g., less than about ten percent).

Figure 9:
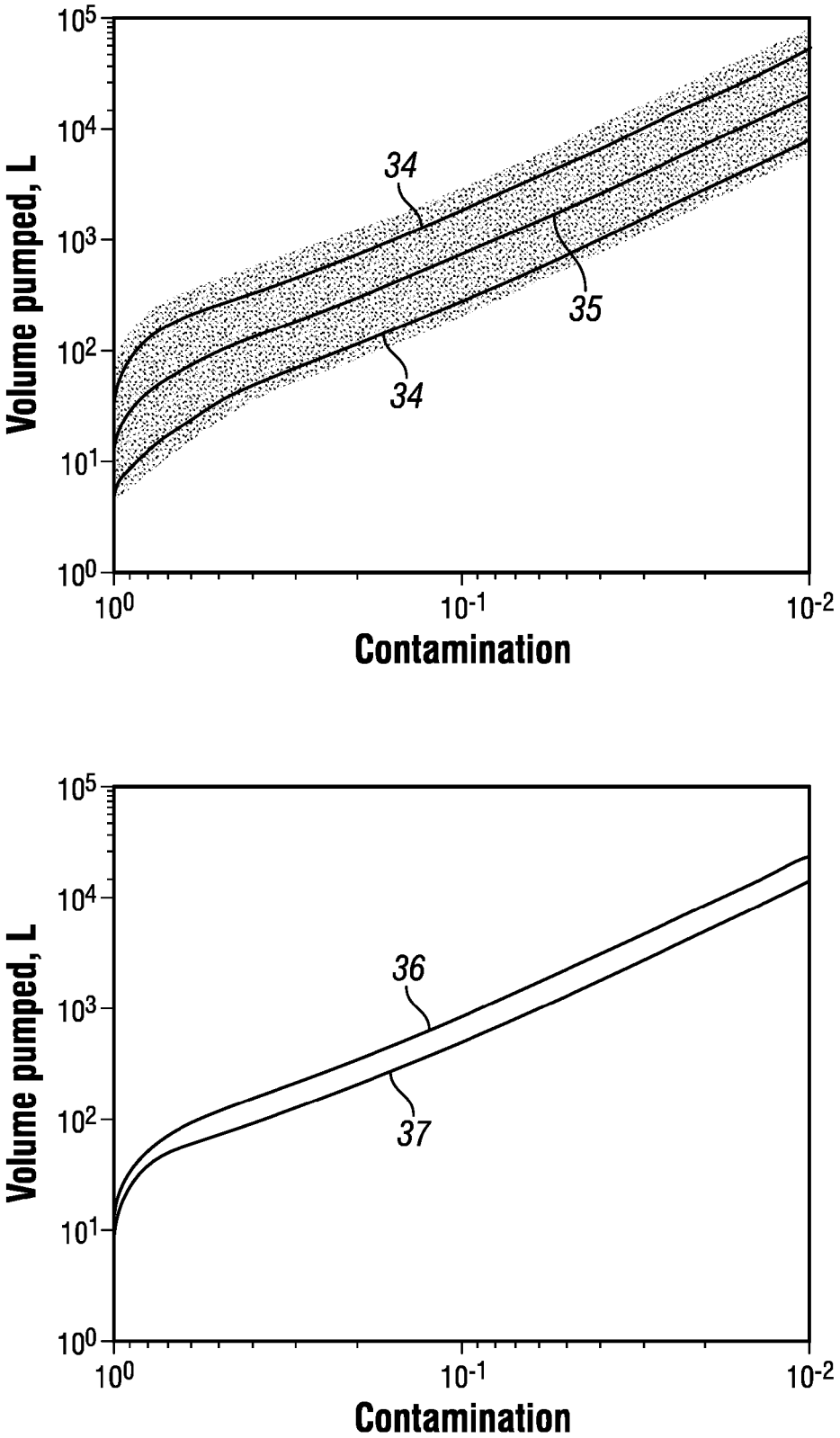
FIG. 9 contains two graphs depicting one or more aspects of the present disclosure.
Figure 10:
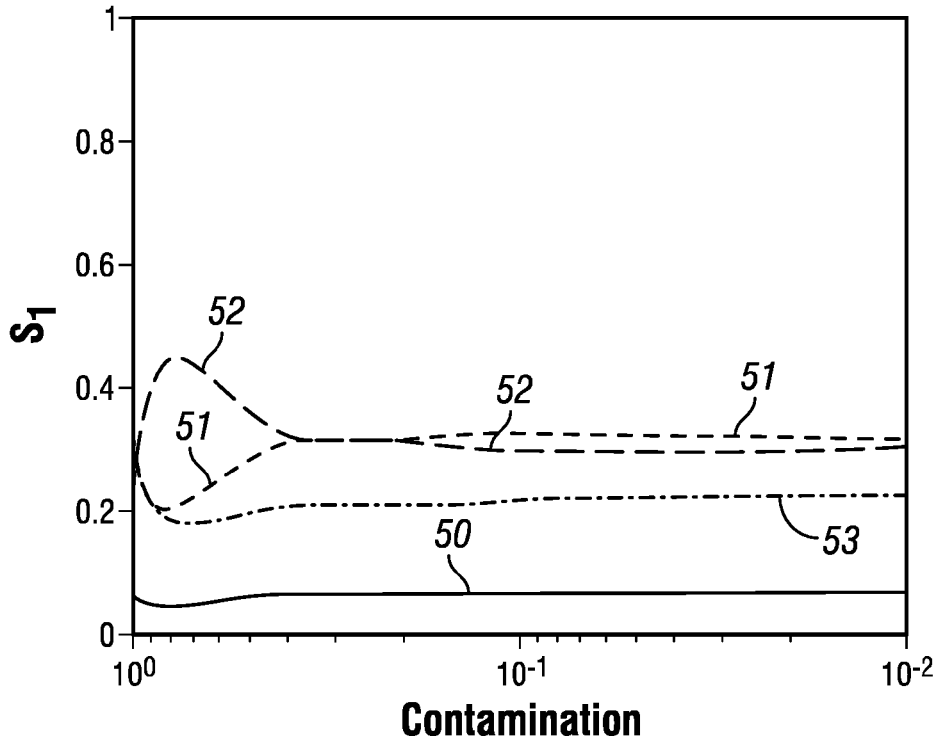
FIG. 10 contains two graphs depicting one or more aspects of the present disclosure.
Figure 10:
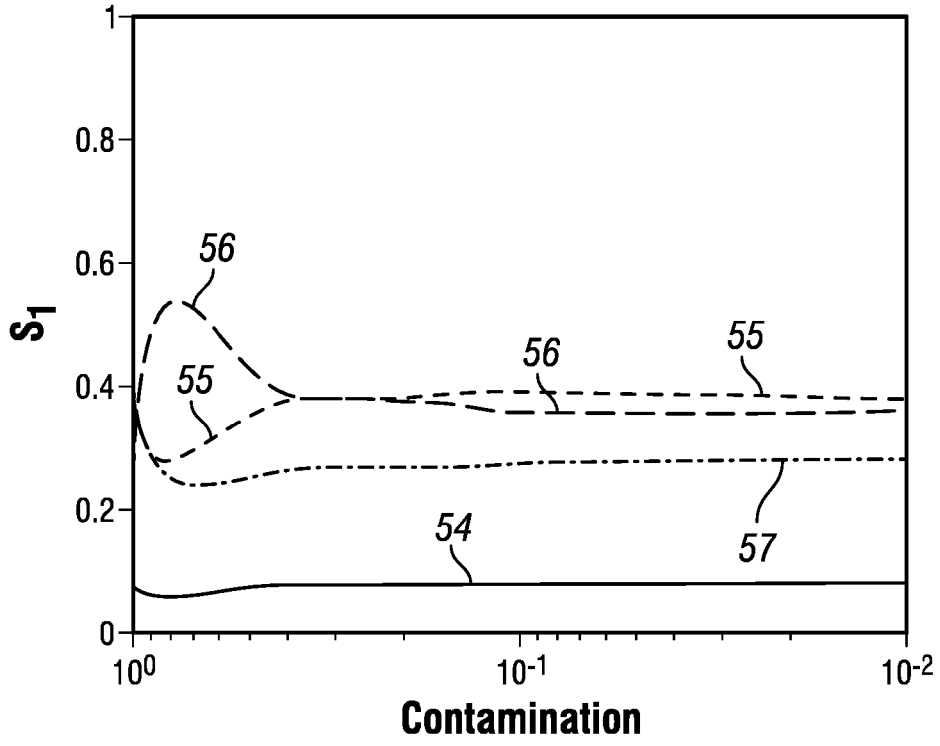

Another illustration of the presently disclosed workflow is shown in FIGS. 9 and 10. FIG. 9 depicts example predicted cleanup volume as a function of contamination level. The example illustrates uncertain moderate invasion due to low viscosity of the filtrate and relatively high horizontal permeability. Parameter ranges utilized for this example include $\varphi$=[0.15; 0.25], $K_v/K_h$=[0.1; 1], $\mu_0/\mu_{mf}$=[1; 10], DOI=[10 in; 15 in], and $D_w$=8.5 in. FIG. 9 includes two graphs, including a first graph (on the left) showing example results of 2000 proxy model realizations (with a P05-P95 envelope, lines 34, and a P50 curve, line 35), and a second graph (on the right) showing example mean value (line 36) and standard deviation (line 37) of the cleanup volume. FIGS. 9 and 10 consider moderate invasion due to lower filtrate viscosity and relatively higher horizontal permeability. The estimated standard deviation of the cleanup volume at about five percent contamination is as high as about 1000 L, equivalent to about 28 hours of pumping at a rate of about ten cc/s. Even with pumping at a rate of about twenty cc/s, the cleanup estimate is about fourteen hours.

Results of associated GSA are shown in FIG. 10. FIG. 10 includes two graphs including a first graph (on the left) depicting first-order sensitivity indices and a second graph (on the right) depicting total sensitivity indices, representing relative contributions from four uncertain input parameters to the total variance of predicted cleanup volume as a function of contamination level. The first order sensitivity indices in the first graph include porosity (curve 50), $K_v/K_h$ (curve 51), $\mu_0/\mu_{mf}$ (curve 52), and DOI (curve 53), and the total sensitivity indices in the second graph include porosity (line 54), $K_v/K_h$ (curve 55), $\mu_0/\mu_{mf}$ (curve 56), and DOI (curve 57). Based on the first-order sensitivity indices shown in FIG. 10 (on the left), uncertainty in $K_v/K_h$ and $\mu_0/\mu_{mf}$ are the two biggest contributors to the uncertainty of the cleanup volume. Their combined contribution is almost seventy percent for contamination levels below about fifty percent. Uncertainty in depth of invasion contributes approximately twenty percent to the variance of $V_p$. Assuming a pumpout rate of about ten cc/s, an accurate estimate for either $K_v/K_h$ or $\mu_0/\mu_{mf}$ may reduce the standard deviation of the cleanup time from about 28 hours to about 22.6 hours, or to about 15.3 hours if both are accurately measured. An accurate estimate of DOI may reduce the cleanup time uncertainty by about three hours, which is quite different on a relative basis, albeit with significant effect, compared to the above example with deeper invasion (FIGS. 7 and 8).

The values of GSA indices and their dynamics (e.g., variation with change in contamination level) may depend on the assumed ranges of the uncertain input parameters and their assigned distributions. These assumptions may be made based on available data regarding the intended sampling interval to ensure that the GSA-based recommendations are relevant and representative.

Figure 11:
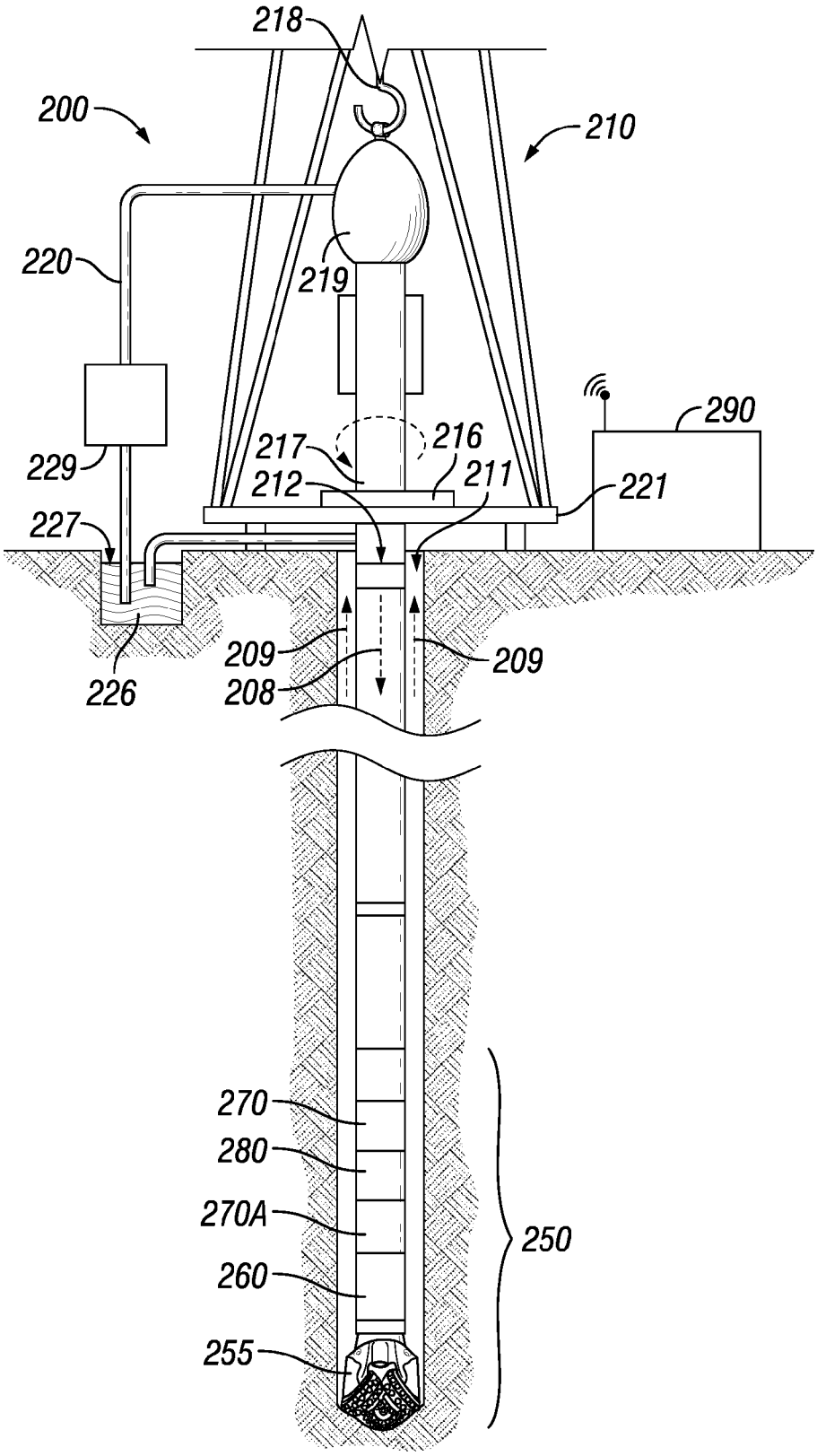
FIG. 11 is a schematic view of at least a portion of apparatus according to one or more aspects of the present disclosure.

FIG. 11 is a schematic view of an example wellsite system 200 in which one or more aspects of contamination monitoring and/or cleanup prediction disclosed herein may be employed. The wellsite may be onshore or offshore. In the example system 200 shown in FIG. 11, a wellbore 211 is formed in subterranean formations by rotary drilling. However, other example systems within the scope of the present disclosure may also or instead utilize directional drilling.

As shown in FIG. 11, a drillstring 212 suspended within the wellbore 211 comprises a bottom hole assembly (BHA) 250 that includes or is coupled with a drill bit 255 at its lower end. The surface system includes a platform and derrick assembly 210 positioned over the wellbore 211. The assembly 210 may comprise a rotary table 216, a kelly 217, a hook 218, and a rotary swivel 219. The drill string 212 may be suspended from a lifting gear (not shown) via the hook 218, with the lifting gear being coupled to a mast (not shown) rising above the surface. An example lifting gear includes a crown block whose axis is affixed to the top of the mast, a vertically traveling block to which the hook 218 is attached, and a cable passing through the crown block and the vertically traveling block. In such an example, one end of the cable is affixed to an anchor point, whereas the other end is affixed to a winch to raise and lower the hook 218 and the drillstring 212 coupled thereto. The drillstring 212 comprises one or more types of drill pipes threadedly attached one to another, perhaps including wired drilled pipe.

The drillstring 212 may be raised and lowered by turning the lifting gear with the winch, which may sometimes include temporarily unhooking the drillstring 212 from the lifting gear. In such scenarios, the drillstring 212 may be supported by blocking it with wedges in a conical recess of the rotary table 216, which is mounted on a platform 221 through which the drillstring 212 passes.

The drillstring 212 may be rotated by the rotary table 216, which engages the kelly 217 at the upper end of the drillstring 212. The drillstring 212 is suspended from the hook 218, attached to a traveling block (not shown), through the kelly 217 and the rotary swivel 219, which permits rotation of the drillstring 212 relative to the hook 218. Other example wellsite systems within the scope of the present disclosure may utilize a top drive system to suspend and rotate the drillstring 212, whether in addition to or instead of the illustrated rotary table system.

The surface system may further include drilling fluid or mud 226 stored in a pit 227 formed at the wellsite. As described above, the drilling fluid 226 may comprise OBM or WBM. A pump 229 delivers the drilling fluid 226 to the interior of the drillstring 212 via a hose or other conduit 220 coupled to a port in the swivel 219, causing the drilling fluid to flow downward through the drillstring 212 as indicated by the directional arrow 208. The drilling fluid exits the drillstring 212 via ports in the drill bit 255, and then circulates upward through the annulus region between the outside of the drillstring 212 and the wall of the wellbore 211, as indicated by the directional arrows 209. In this manner, the drilling fluid 226 lubricates the drill bit 255 and carries formation cuttings up to the surface as it is returned to the pit 227 for recirculation.

The BHA 250 may comprise one or more specially made drill collars near the drill bit 255. Each such drill collar may comprise one or more logging devices, thereby permitting downhole drilling conditions and/or various characteristic properties of the geological formation (e.g., such as layers of rock or other material) intersected by the wellbore 211 to be measured as the wellbore 211 is deepened. For example, the BHA 250 may comprise a logging-while-drilling (LWD) module 270, a measurement-while-drilling (MWD) module 280, a rotary-steerable system and motor 260, and/or the drill bit 255. Of course, other BHA components, modules, and/or tools are also within the scope of the present disclosure.

The LWD module 270 may be housed in a drill collar and may comprise one or more logging tools. More than one LWD and/or MWD module may be employed, e.g., as represented at 270A. References herein to a module at the position of 270 may mean a module at the position of 270A as well. The LWD module 270 may comprise capabilities for measuring, processing, and storing information, as well as for communicating with the surface equipment.

The MWD module 280 may also be housed in a drill collar and may comprise one or more devices for measuring characteristics of the drillstring 212 and/or drill bit 255. The MWD module 280 may further comprise an apparatus (not shown) for generating electrical power to be utilized by the downhole system. This may include a mud turbine generator powered by the flow of the drilling fluid 226. However, other power and/or battery systems may also or instead be employed. In the example shown in FIG. 11, the MWD module 280 comprises one or more of the following types of measuring devices: a weight-on-bit measuring device, a torque measuring device, a vibration measuring device, a shock measuring device, a stick slip measuring device, a direction measuring device, and an inclination measuring device, among others within the scope of the present disclosure. The wellsite system 200 also comprises a logging and control unit and/or other surface equipment 290 communicably coupled to the LWD modules 270/270A and/or the MWD module 280.

At least one of the LWD modules 270/270A and/or the MWD module 280 comprises a downhole tool operable to obtain downhole a sample of fluid from the subterranean formation and perform downhole fluid analysis (DFA) to measure or estimate the composition and/or other properties of the obtained fluid sample. Such DFA may be utilized for contamination monitoring and/or cleanup prediction according to one or more aspects described elsewhere herein. The downhole fluid analyzer may then report the resulting data to the surface equipment 290.

The operational elements of the BHA 250 may be controlled by one or more electrical control systems within the BHA 250 and/or the surface equipment 290. For example, such control system(s) may include processor capability for characterization of formation fluids in one or more components of the BHA 250 according to one or more aspects of the present disclosure. Methods within the scope of the present disclosure may be embodied in one or more computer programs that run in one or more processors located, for example, in one or more components of the BHA 250 and/or the surface equipment 290. Such programs may utilize data received from one or more components of the BHA 250, for example, via mud-pulse telemetry and/or other telemetry means, and may be operable to transmit control signals to operative elements of the BHA 250. The programs may be stored on a suitable computer-usable storage medium associated with one or more processors of the BHA 250 and/or surface equipment 290, or may be stored on an external computer-usable storage medium that is electronically coupled to such processor(s). The storage medium may be one or more known or future-developed storage media, such as a magnetic disk, an optically readable disk, flash memory, or a readable device of another kind, including a remote storage device coupled over a telemetry link, among others.

Figure 12:
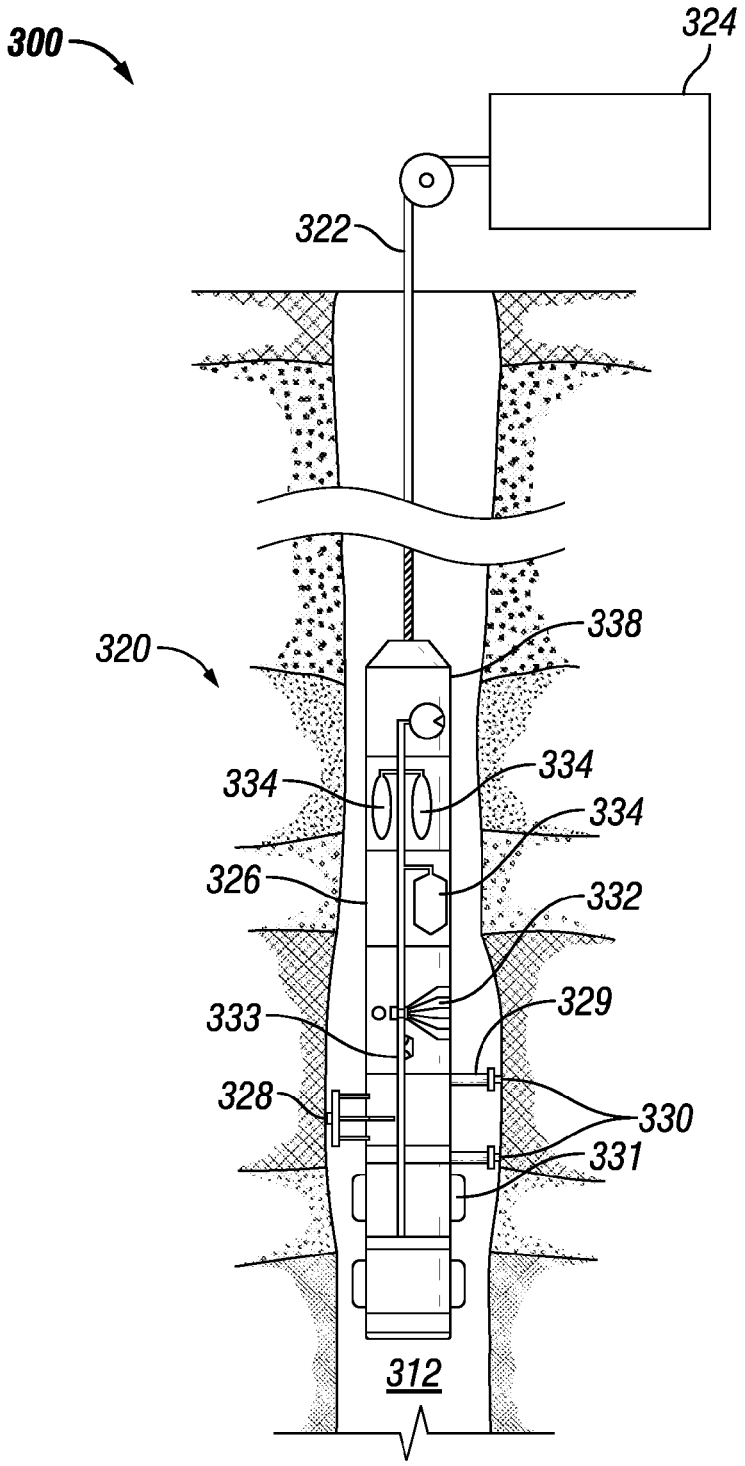
FIG. 12 is a schematic view of at least a portion of apparatus according to one or more aspects of the present disclosure.

FIG. 12 is a schematic view of another example operating environment of the present disclosure wherein a downhole tool 320 is suspended at the end of a wireline 322 at a wellsite having a wellbore 312. The downhole tool 320 and wireline 322 are structured and arranged with respect to a service vehicle (not shown) at the wellsite. As with the system 200 shown in FIG. 11, the example system 300 of FIG. 12 may be utilized for downhole sampling and analysis of formation fluids. The system 300 includes the downhole tool 320, which may be used for testing earth formations and analyzing the composition of fluids from a formation, and also includes associated telemetry and control devices and electronics, and surface control and communication equipment 324. The downhole tool 320 is suspended in the wellbore 312 from the lower end of the wireline 322, which may be a multi-conductor logging cable spooled on a winch (not shown). The wireline 322 is electrically coupled to the surface equipment 324, which may have one or more aspects in common with the surface equipment 290 shown in FIG. 11.

The downhole tool 320 comprises an elongated body 326 encasing a variety of electronic components and modules, which are schematically represented in FIG. 12, for providing functionality to the downhole tool 320. A selectively extendible fluid admitting assembly 328 and one or more selectively extendible anchoring members 330 are respectively arranged on opposite sides of the elongated body 326. The fluid admitting assembly 328 is operable to selectively seal off or isolate selected portions of the wellbore wall 312 such that pressure or fluid communication with the adjacent formation may be established. The fluid admitting assembly 328 may be or comprise a single probe module 329 and/or a packer module 331.

One or more fluid sampling and analysis modules 332 are provided in the tool body 326. Fluids obtained from the formation and/or wellbore flow through a flowline 333, via the fluid analysis module or modules 332, and then may be discharged through a port of a pumpout module 338. Further, formation fluids in the flowline 333 may be directed to one or more fluid collecting chambers 334 for receiving and retaining the fluids obtained from the formation for transportation to the surface.

The fluid admitting assemblies, one or more fluid analysis modules, the flow path, the collecting chambers, and/or other operational elements of the downhole tool 320 may be controlled by one or more electrical control systems within the downhole tool 320 and/or the surface equipment 324. For example, such control system(s) may include processor capability for characterization of formation fluids in the downhole tool 320 according to one or more aspects of the present disclosure. Methods within the scope of the present disclosure may be embodied in one or more computer programs that run in one or more processors located, for example, in the downhole tool 320 and/or the surface equipment 324. Such programs may utilize data received from, for example, the fluid sampling and analysis module 332, via the wireline cable 322, and may be operable to transmit control signals to operative elements of the downhole tool 320. The programs may be stored on a suitable computer-usable storage medium associated with the one or more processors of the downhole tool 320 and/or surface equipment 324, or may be stored on an external computer-usable storage medium that is electronically coupled to such processor(s). The storage medium may be one or more known or future-developed storage media, such as a magnetic disk, an optically readable disk, flash memory, or a readable device of another kind, including a remote storage device coupled over a switched telecommunication link, among others.

FIGS. 11 and 12 illustrate mere examples of environments in which one or more aspects of the present disclosure may be implemented. For example, in addition to the drillstring environment of FIG. 11 and the wireline environment of FIG. 12, one or more aspects of the present disclosure may be applicable or readily adaptable for implementation in other environments utilizing other means of conveyance within the wellbore, including coiled tubing, TLC, slickline, and others.

Figure 13:
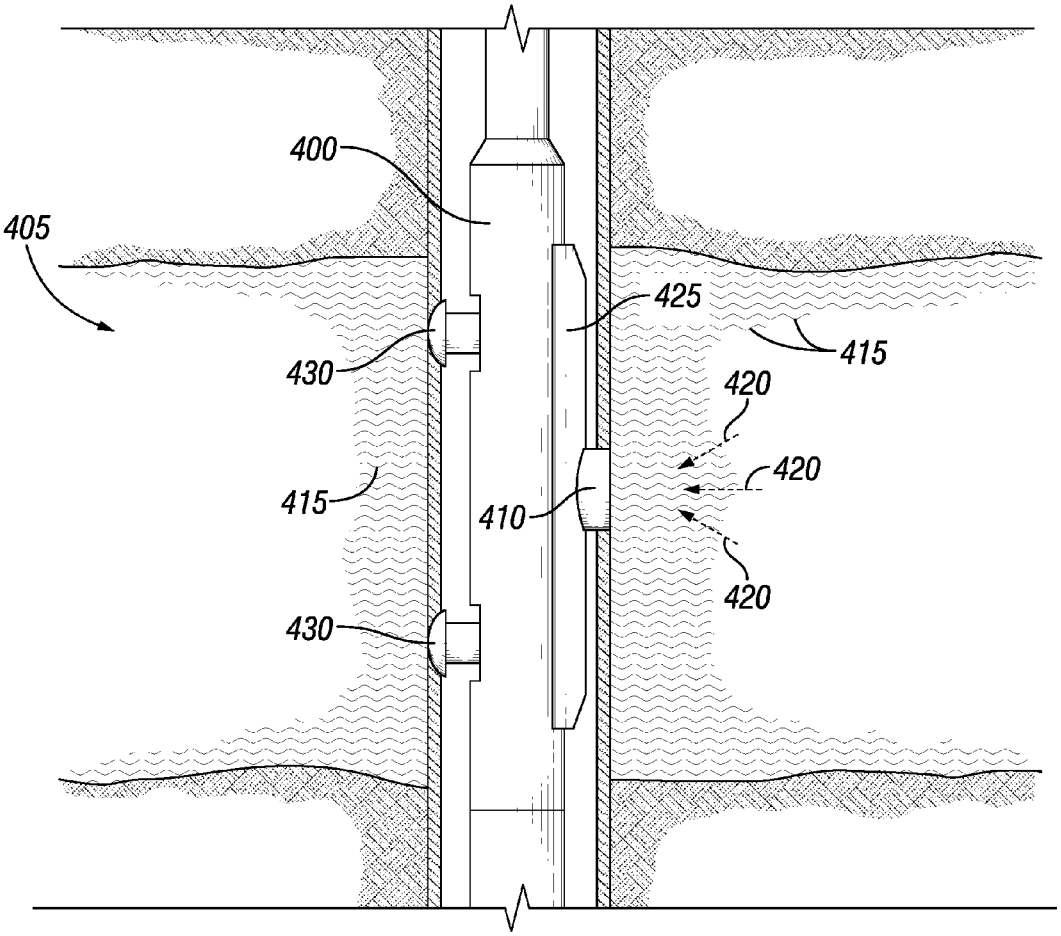
FIG. 13 is a schematic view of at least a portion of apparatus according to one or more aspects of the present disclosure.

An example downhole tool or module 400 that may be utilized in the example systems 200 and 300 of FIGS. 11 and 12, respectively, such as to obtain a sample of fluid from a subterranean formation 405 and perform DFA for contamination monitoring and/or cleanup prediction of the obtained fluid sample, is schematically shown in FIG. 13. The tool 400 is provided with a probe 410 for establishing fluid communication with the formation 405 and drawing formation fluid 415 into the tool, as indicated by arrows 420. The probe 410 may be positioned in a stabilizer blade 425 of the tool 400, and may be extended therefrom to engage the wellbore wall. The stabilizer blade 425 may be or comprise one or more blades that are in contact with the wellbore wall. The tool 400 may comprise backup pistons 430 operable to press the tool 400 and, thus, the probe 410 into contact with the wellbore wall. Fluid drawn into the tool 400 via the probe 410 may be measured to determine the various properties described above, for example. The tool 400 may also comprise one or more chambers and/or other devices for collecting fluid samples for retrieval at the surface.

Figure 14:
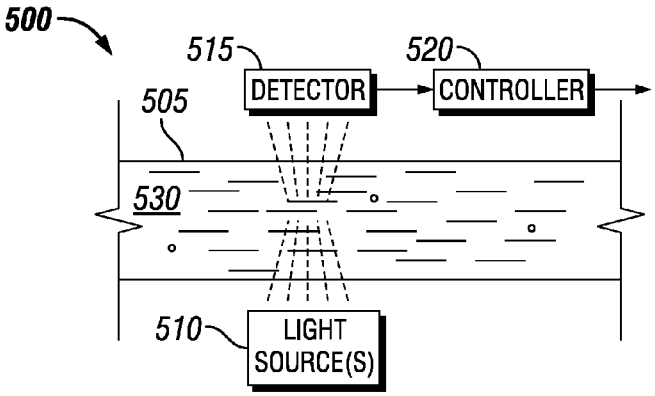
FIG. 14 is a schematic view of at least a portion of apparatus according to one or more aspects of the present disclosure.

An example downhole fluid analyzer 500 that may be used to implement DFA in the example downhole tool 400 shown in FIG. 13 is schematically shown in FIG. 14. The downhole fluid analyzer 500 may be part of or otherwise work in conjunction with a downhole tool operable to obtain a sample of fluid 530 from the formation, such as the downhole tools/modules shown in FIGS. 11-13. For example, a flowline 505 of the downhole tool may extend past an optical spectrometer having one or more light sources 510 and a detector 515. The detector 515 senses light that has transmitted through the formation fluid 530 in the flowline 505, resulting in optical spectra that may be utilized according to one or more aspects of the present disclosure. For example, a controller 520 associated with the downhole fluid analyzer 500 and/or the downhole tool may utilize measured optical spectra to perform contamination monitoring and/or cleanup prediction of the formation fluid 530 in the flowline 505 according to one or more aspects introduced herein. The resulting information may then be reported via telemetry to surface equipment, such as the surface equipment 290 shown in FIG. 11 and/or the surface equipment 324 shown in FIG. 12. Moreover, the downhole fluid analyzer 500 may perform the bulk of its processing downhole and report just a relatively small amount of measurement data up to the surface. Thus, the downhole fluid analyzer 500 may provide high-speed (e.g., real time) DFA measurements using a relatively low bandwidth telemetry communication link. As such, the telemetry communication link may be implemented by most types of communication links, unlike conventional DFA techniques that utilize high-speed communication links to transmit high-bandwidth signals to the surface.

Figure 15:
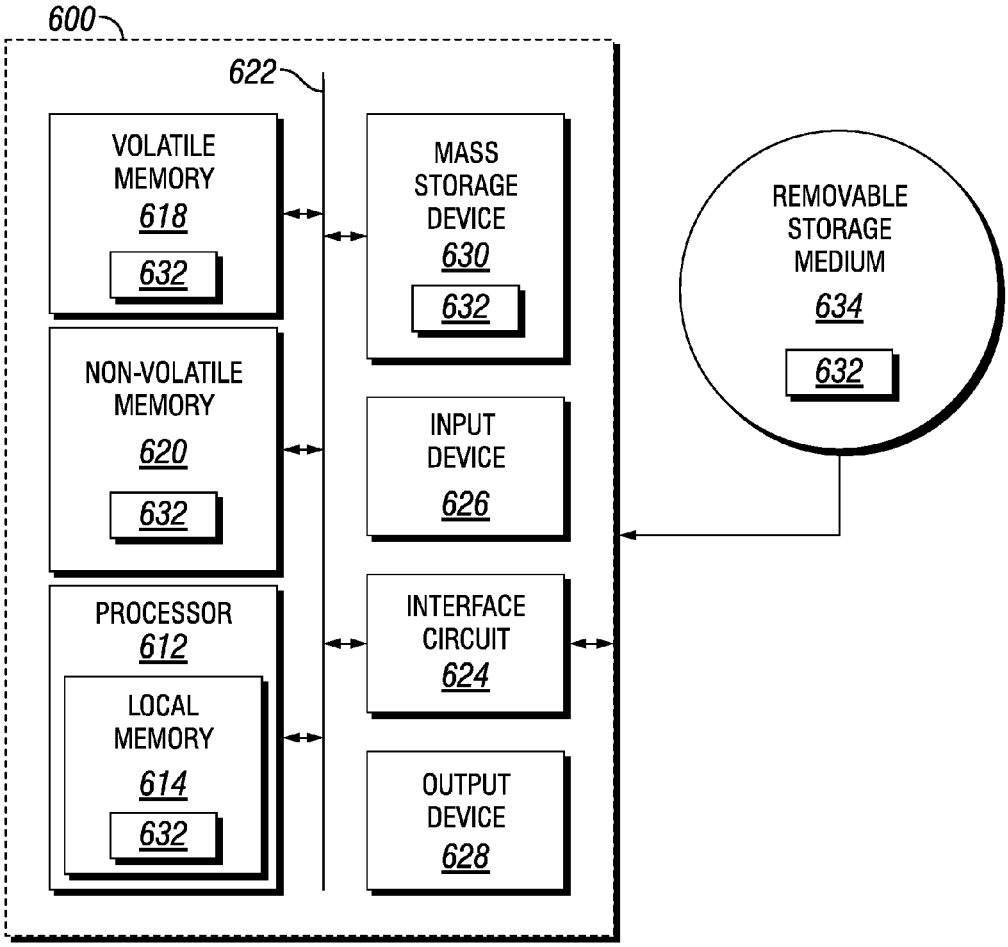
FIG. 15 is a schematic view of at least a portion of apparatus according to one or more aspects of the present disclosure.

FIG. 15 is a schematic view of at least a portion of apparatus according to one or more aspects of the present disclosure. The apparatus is or comprises a processing system 600 that may execute example machine-readable instructions to implement at least a portion of one or more of the methods and/or processes described herein, and/or to implement a portion of one or more of the example downhole tools described herein. The processing system 600 may be or comprise, for example, one or more processors, controllers, special-purpose computing devices, servers, personal computers, personal digital assistant ("PDA") devices, smartphones, internet appliances, and/or other types of computing devices. Moreover, while it is possible that the entirety of the processing system 600 shown in FIG. 15 is implemented within downhole apparatus, such as the LWD module 270/270A and/or MWD module 280 shown in FIG. 11, the fluid sampling and analysis module 332 shown in FIG. 12, the controller 520 shown in FIG. 14, other components shown in one or more of FIGS. 11-14, and/or other downhole apparatus, it is also contemplated that one or more components or functions of the processing system 600 may be implemented in wellsite surface equipment, perhaps including the surface equipment 290 shown in FIG. 11, the surface equipment 324 shown in FIG. 12, and/or other surface equipment.

The processing system 600 may comprise a processor 612 such as, for example, a general-purpose programmable processor. The processor 612 may comprise a local memory 614, and may execute coded instructions 632 present in the local memory 614 and/or another memory device. The processor 612 may execute, among other things, machine-readable instructions or programs to implement the methods and/or processes described herein. The programs stored in the local memory 614 may include program instructions or computer program code that, when executed by an associated processor, may permit surface equipment and/or downhole controller and/or control system to perform tasks as described herein. The processor 612 may be, comprise, or be implemented by one or more processors of various types suitable to the local application environment, and may include one or more of general-purpose computers, special-purpose computers, microprocessors, digital signal processors ("DSPs"), field-programmable gate arrays ("FPGAs"), application-specific integrated circuits ("ASICs"), and processors based on a multi-core processor architecture, as non-limiting examples. Of course, other processors from other families are also appropriate.

The processor 612 may be in communication with a main memory, such as may include a volatile memory 618 and a non-volatile memory 620, perhaps via a bus 622 and/or other communication means. The volatile memory 618 may be, comprise, or be implemented by random access memory (RAM), static random access memory (SRAM), synchronous dynamic random access memory (SDRAM), dynamic random access memory (DRAM), RAMBUS dynamic random access memory (RDRAM) and/or other types of random access memory devices. The non-volatile memory 620 may be, comprise, or be implemented by read-only memory, flash memory and/or other types of memory devices. One or more memory controllers (not shown) may control access to the volatile memory 618 and/or the non-volatile memory 620.

The processing system 600 may also comprise an interface circuit 624. The interface circuit 624 may be, comprise, or be implemented by various types of standard interfaces, such as an Ethernet interface, a universal serial bus (USB), a third generation input/output (3GIO) interface, a wireless interface, and/or a cellular interface, among others. The interface circuit 624 may also comprise a graphics driver card. The interface circuit 624 may also comprise a communication device such as a modem or network interface card to facilitate exchange of data with external computing devices via a network (e.g., Ethernet connection, digital subscriber line ("DSL"), telephone line, coaxial cable, cellular telephone system, satellite, etc.).

One or more input devices 626 may be connected to the interface circuit 624. The input device(s) 626 may permit a user to enter data and commands into the processor 612. The input device(s) 626 may be, comprise, or be implemented by, for example, a keyboard, a mouse, a touchscreen, a track-pad, a trackball, an isopoint, and/or a voice recognition system, among others.

One or more output devices 628 may also be connected to the interface circuit 624. The output devices 628 may be, comprise, or be implemented by, for example, display devices (e.g., a liquid crystal display or cathode ray tube display (CRT), among others), printers, and/or speakers, among others.

The processing system 600 may also comprise one or more mass storage devices 630 for storing machine-readable instructions and data. Examples of such mass storage devices 630 include floppy disk drives, hard drive disks, compact disk (CD) drives, and digital versatile disk (DVD) drives, among others. The coded instructions 632 may be stored in the mass storage device 630, the volatile memory 618, the non-volatile memory 620, the local memory 614, and/or on a removable storage medium 634, such as a CD or DVD. Thus, the modules and/or other components of the processing system 600 may be implemented in accordance with hardware (embodied in one or more chips including an integrated circuit such as an application specific integrated circuit), or may be implemented as software or firmware for execution by a processor. In particular, in the case of firmware or software, the embodiment can be provided as a computer program product including a computer readable medium or storage structure embodying computer program code (i.e., software or firmware) thereon for execution by the processor.

In view of the entirety of the present disclosure, including the figures and the claims, a person having ordinary skill in the art will readily recognize that the present disclosure introduces a method comprising: operating a processing system comprising a processor and a memory to generate a proxy model by utilizing a true numerical model, wherein: the true model utilizes a plurality of true model input parameters that include: (a) a pumping parameter descriptive of a pumpout time or volume of fluid to be obtained from a subterranean formation by a downhole sampling tool positioned in a wellbore extending into the subterranean formation; (b) a plurality of formation parameters descriptive of the subterranean formation; and (c) a filtrate parameter descriptive of a drilling fluid utilized to form the wellbore; the output of the true model is contamination of the obtained fluid as a function of the pumping parameter; the proxy model utilizes a plurality of proxy model input parameters each related to one or more of the true model input parameters; the output of the proxy model is the pumping parameter as a function of the contamination; and generating the proxy model comprises: (a) utilizing the true model to generate a plurality of true solutions for each of a plurality of different combinations of values of each of the plurality of true model input parameters; and (b) estimating fitting parameters of the proxy model utilizing the true solutions.

The proxy model may include a regression function that approximates the proxy model output via interpolation utilizing the true solutions. The interpolation may be kriging-based interpolation. The interpolation may approximate the proxy model output as a plurality of low-order polynomials. The low-order polynomials may be second-order polynomials. The proxy model may further include a correlation function that weights the regression-approximated proxy model output utilizing the true solutions. The correlation function may be at least one of a Gaussian function, an exponential function, and/or a spline function.

The number of proxy model input parameters may be less than the number of true model input parameters. The ones of the true model input parameters that are related to the proxy model input parameters may each independently affect a cleanup behavior of the pumped fluid, and others of the true model input parameters may not be related to the proxy model input parameters and may not independently affect the cleanup behavior. Each of the proxy model input parameters may be dimensionless, and each of the true model input parameters may not be dimensionless. For example, the true model input parameters may include at least two of porosity of the subterranean formation, absolute horizontal permeability of the subterranean formation, absolute permeability anisotropy of the subterranean formation, viscosity of the fluid to be obtained from the subterranean formation, viscosity of the contamination, depth of invasion of the contamination into the subterranean formation from the center of the wellbore, diameter of the wellbore, and the pumping parameter, and the proxy model input parameters may include at least one of a first ratio of the depth of contamination invasion to the wellbore diameter, a second ratio of the viscosity of the fluid to be obtained from the subterranean formation to the contamination viscosity, and the absolute permeability anisotropy of the subterranean formation. The true model input parameters may include each of porosity of the subterranean formation, absolute horizontal permeability of the subterranean formation, absolute permeability anisotropy of the subterranean formation, viscosity of the fluid to be obtained from the subterranean formation, viscosity of the contamination, depth of invasion of the contamination into the subterranean formation from the center of the wellbore, diameter of the wellbore, and the pumping parameter, and the proxy model input parameters may include each of a first ratio of the depth of contamination invasion to the wellbore diameter, a second ratio of the viscosity of the fluid to be obtained from the subterranean formation to the contamination viscosity, and the absolute permeability anisotropy of the subterranean formation.

The processing system, the processor, and the memory may be a first processing system, a first processor, and a first memory, respectively. The first processing system may be separate and distinct from a second processing system comprising a second processor and a second memory. The method may further comprise operating one of the first and second processing systems to evaluate each of a plurality of sampling job scenarios utilizing the proxy model. Evaluating the sampling job scenarios may comprise: randomly selecting values for each one of the proxy model input parameters that is unknown in the sampling job scenarios; utilizing the proxy model to generate a plurality of estimates of the pumping parameter at a predetermined contamination utilizing the randomly selected values for each of the unknown proxy model input parameters; and generating statistical estimates for the generated plurality of the pumping parameter estimates. The method may further comprise: applying a global sensitivity analysis to the plurality of estimated pumping parameter values; and identifying a formation or filtrate parameter that most influences the uncertainty in the estimated pumping parameter. Identifying the parameter may comprise quantifying a contribution of the parameter to the uncertainty in the estimated pumping parameter. The method may further comprise measuring the identified parameter.

The method may further comprise: obtaining values of the formation and filtrate parameters representative of the subterranean formation at a particular depth in the wellbore; and using the proxy model and the obtained values to evaluate performance of the downhole sampling tool by estimating the pumping parameter value corresponding to a predetermined level of contamination of fluid to be obtained from the subterranean formation by the downhole sampling tool at the particular depth. The method may further comprise repeating the operating and using steps for at least two downhole sampling tools. The method may further comprise repeating the operating, obtaining, and using steps for at least two different depths within the wellbore.

The present disclosure also introduces a method of evaluating performance of a downhole sampling tool in a formation traversed by a wellbore comprising: (a) generating a proxy model by utilizing a true numerical model of a downhole tool, wherein: (1) the true model utilizes a plurality of true model input parameters that include: (i) a pumping parameter descriptive of a pumpout time or volume of fluid to be obtained from a subterranean formation by a downhole sampling tool positioned in a wellbore extending into the subterranean formation; (ii) a plurality of formation parameters descriptive of the subterranean formation; and (iii) a filtrate parameter descriptive of a drilling fluid utilized to form the wellbore; (2) the output of the true model is contamination of the obtained fluid as a function of the pumping parameter; (3) the proxy model utilizes a plurality of proxy model input parameters each related to one or more of the true model input parameters; (4) the output of the proxy model is the pumping parameter as a function of the contamination; and (4) generating the proxy model comprises: (i) utilizing the true model to generate a plurality of true solutions for each of a plurality of different combinations of values of each of the plurality of true model input parameters; and (ii) estimating fitting parameters of the proxy model utilizing the true solutions; (b) obtaining values of formation and filtrate input parameters representative of formation at a particular depth; and (c) using the proxy model for the downhole tool and the values of the input parameters to evaluate performance of a downhole sampling tool by estimating pumpout time or volume required to reach desired contamination level of a sampled fluid at a particular depth in a formation; wherein steps (a) and (c) are performed by one or more processing systems each comprising a processor and a memory.

The present disclosure also introduces a method of operating a processing system comprising a processor and a memory, comprising utilizing a proxy model to generate a pumping parameter as a function of contamination, wherein: the pumping parameter is descriptive of a pumpout time or volume of fluid to be obtained from a subterranean formation by a downhole sampling tool positioned in a wellbore extending into the subterranean formation; the contamination is a percentage of the fluid obtained by the downhole sampling tool that is not native to the subterranean formation; the proxy model is based on a true model; the true model utilizes a plurality of true model input parameters that include: (i) the pumping parameter; (ii) a plurality of formation parameters descriptive of the subterranean formation; and (iii) a filtrate parameter descriptive of a drilling fluid utilized to form the wellbore; the output of the true model is the contamination as a function of the pumping parameter; and the proxy model utilizes a plurality of proxy model input parameters each related to one or more of the true model input parameters.

The proxy model may be generated by: utilizing the true model to generate a plurality of true solutions for each of a plurality of different combinations of values of each of the plurality of true model input parameters; and estimating fitting parameters of the proxy model utilizing the true solutions.

The method may further comprise operating the processing system to evaluate each of a plurality of sampling job scenarios utilizing the proxy model. Evaluating the sampling job scenarios may comprise: randomly selecting values for each one of the proxy model input parameters that is unknown in the sampling job scenarios; utilizing the proxy model to generate statistical estimates of the pumping parameter at a predetermined contamination utilizing the randomly selected values for each of the unknown proxy model input parameters; and generating uncertainties exhibited by the statistical estimates.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. A method comprising:

operating a processing system comprising a processor and a memory to generate a proxy model by utilizing a true numerical model, wherein:

the true model utilizes a plurality of true model input parameters that include:

a pumping parameter descriptive of a pumpout time or volume of fluid to be obtained from a subterranean formation by a downhole sampling tool positioned in a wellbore extending into the subterranean formation;

a plurality of formation parameters descriptive of the subterranean formation; and a filtrate parameter descriptive of a drilling fluid utilized to form the wellbore;

the output of the true model is contamination of the obtained fluid as a function of the pumping parameter;

the proxy model utilizes a plurality of proxy model input parameters each related to one or more of the true model input parameters;

the output of the proxy model is the pumping parameter as a function of the contamination; and generating the proxy model comprises:

utilizing the true model to generate a plurality of true solutions for each of a plurality of different combinations of values of each of the plurality of true model input parameters; and estimating fitting parameters of the proxy model utilizing the true solutions.

2. The method of claim 1 wherein the proxy model includes a regression function that approximates the proxy model output via interpolation utilizing the true solutions.

3. The method of claim 2 wherein the interpolation is kriging-based interpolation.

4. The method of claim 2 wherein the interpolation approximates the proxy model output as a plurality of low-order polynomials.

5. The method of claim 2 wherein the proxy model further includes a correlation function that weights the regression-approximated proxy model output utilizing the true solutions.

6. The method of claim 5 wherein the correlation function is at least one of a Gaussian function, an exponential function, and/or a spline function.

7. The method of claim 1 wherein the number of proxy model input parameters is less than the number of true model input parameters.

8. The method of claim 7 wherein the ones of the true model input parameters that are related to the proxy model input parameters each independently affect a cleanup behavior of the pumped fluid, and wherein others of the true model input parameters are not related to the proxy model input parameters and do not independently affect the cleanup behavior.

9. The method of claim 7 wherein each of the proxy model input parameters is dimensionless, and wherein each of the true model input parameters is not dimensionless.

10. The method of claim 7 wherein:

the true model input parameters include at least two of:

porosity of the subterranean formation;

absolute horizontal permeability of the subterranean formation;

absolute permeability anisotropy of the subterranean formation;

viscosity of the fluid to be obtained from the subterranean formation;

viscosity of the contamination;

depth of invasion of the contamination into the subterranean formation from the center of the wellbore;

diameter of the wellbore; and the pumping parameter; and the proxy model input parameters include at least one of:

a first ratio of the depth of contamination invasion to the wellbore diameter;

a second ratio of the viscosity of the fluid to be obtained from the subterranean formation to the contamination viscosity; and the absolute permeability anisotropy of the subterranean formation.

11. The method of claim 1 wherein:

the processing system, the processor, and the memory are a first processing system, a first processor, and a first memory, respectively;

the first processing system is separate and distinct from a second processing system comprising a second processor and a second memory; and the method further comprises operating one of the first and second processing systems to evaluate each of a plurality of sampling job scenarios utilizing the proxy model.

12. The method of claim 11 wherein evaluating the sampling job scenarios comprises:

randomly selecting values for each one of the proxy model input parameters that is unknown in the sampling job scenarios;

utilizing the proxy model to generate a plurality of estimates of the pumping parameter at a predetermined contamination utilizing the randomly selected values for each of the unknown proxy model input parameters; and generating statistical estimates for the generated plurality of the pumping parameter estimates.

13. The method of claim 12 further comprising:

applying a global sensitivity analysis to the plurality of estimated pumping parameter values; and identifying a formation or filtrate parameter that most influences the uncertainty in the estimated pumping parameter.

14. The method of claim 13 wherein identifying the parameter comprises quantifying a contribution of the parameter to the uncertainty in the estimated pumping parameter.

15. The method of claim 14 further comprising measuring the identified parameter.

16. The method of claim 1 further comprising:

obtaining values of the formation and filtrate parameters representative of the subterranean formation at a particular depth in the wellbore; and using the proxy model and the obtained values to evaluate performance of the downhole sampling tool by estimating the pumping parameter value corresponding to a predetermined level of contamination of fluid to be obtained from the subterranean formation by the downhole sampling tool at the particular depth.

17. The method of claim 16 further comprising repeating the operating and using steps for at least two downhole sampling tools.

18. The method of claim 16 further comprising repeating the operating, obtaining, and using steps for at least two different depths within the wellbore.

19. A method of evaluating performance of a downhole sampling tool in a formation traversed by a wellbore comprising:

(a) generating a proxy model by utilizing a true numerical model of a downhole tool, wherein:

the true model utilizes a plurality of true model input parameters that include:

a pumping parameter descriptive of a pumpout time or volume of fluid to be obtained from a subterranean formation by a downhole sampling tool positioned in a wellbore extending into the subterranean formation;

a plurality of formation parameters descriptive of the subterranean formation; and a filtrate parameter descriptive of a drilling fluid utilized to form the wellbore;

the output of the true model is contamination of the obtained fluid as a function of the pumping parameter;

the proxy model utilizes a plurality of proxy model input parameters each related to one or more of the true model input parameters;

the output of the proxy model is the pumping parameter as a function of the contamination; and generating the proxy model comprises:

utilizing the true model to generate a plurality of true solutions for each of a plurality of different combinations of values of each of the plurality of true model input parameters; and estimating fitting parameters of the proxy model utilizing the true solutions;

(b) obtaining values of formation and filtrate input parameters representative of formation at a particular depth; and (c) using the proxy model for the downhole tool and the values of the input parameters to evaluate performance of a downhole sampling tool by estimating pumpout time or volume required to reach desired contamination level of a sampled fluid at a particular depth in a formation;

wherein steps (a) and (c) are performed by a processing system comprising a processor and a memory.

20. A method of operating a processing system comprising a processor and a memory, comprising:

utilizing a proxy model to generate a pumping parameter as a function of contamination, wherein:

the pumping parameter is descriptive of a pumpout time or volume of fluid to be obtained from a subterranean formation by a downhole sampling tool positioned in a wellbore extending into the subterranean formation;

the contamination is a percentage of the fluid obtained by the downhole sampling tool that is not native to the subterranean formation;

the proxy model is based on a true model;

the true model utilizes a plurality of true model input parameters that include:

the pumping parameter;

a plurality of formation parameters descriptive of the subterranean formation; and a filtrate parameter descriptive of a drilling fluid utilized to form the wellbore;

the output of the true model is the contamination as a function of the pumping parameter; and the proxy model utilizes a plurality of proxy model input parameters each related to one or more of the true model input parameters.

* * * * *